United States Patent [19]

Kawashima et al.

[11] Patent Number: 5,027,114

[45] Date of Patent: Jun. 25, 1991

[54] GROUND GUIDANCE SYSTEM FOR AIRPLANES

[76] Inventors: Kiroshi Kawashima, 14-18, Kamirenjaku 3-chome, Mitaka-shi, Tokyo 181; Koichi Futsuhara, 92-3, Uetake-cho 1-chome, Omiya-shi, Saitama 330; Fumio Wada, 158, Hirogayado, Urawa-shi, Saitama 336, all of Japan

[21] Appl. No.: 249,173

[22] PCT Filed: Jun. 9, 1987

[86] PCT No.: PCT/JP87/00367

§ 371 Date: Aug. 15, 1988

§ 102(e) Date: Aug. 15, 1988

[87] PCT Pub. No.: WO88/09982

PCT Pub. Date: Dec. 15, 1988

[51] Int. Cl.[5] ..... G08G 1/01

[52] U.S. Cl. ..... 340/941; 340/958

[58] Field of Search ..... 340/933, 941, 945, 958, 340/961, 989; 342/36, 29, 63; 364/424.01, 439, 441, 460; 244/114 R; 73/178 R; 180/168

[56] References Cited

U.S. PATENT DOCUMENTS

| | | | |
|---|---|---|---|
| 2,488,815 | 11/1949 | Hailes | 340/941 |
| 3,178,683 | 4/1965 | Phelps | 340/941 |
| 3,706,969 | 12/1972 | Paredes | 340/958 |

OTHER PUBLICATIONS

"At the Crossroads in Air Traffic Control", Friedlander, IEEE Spectrum Jul. 1970, pp. 69, 76, 77.

*Primary Examiner*—Joseph A. Orsino
*Assistant Examiner*—Brent A. Swarthout
*Attorney, Agent, or Firm*—Lowe, Price, Leblanc & Becker

[57] ABSTRACT

A ground guidance system for airplanes in which loop coils of a predetermined shape are continuously buried in a specific section of a taxiway for airplanes, an airplane is continuously detected based on changes of self-inductances of the loop coils with movement of the airplane while discriminating airplanes from other objects and admission or inhibition of advance in the specific section to a subsequent airplane according to the presence or absence of the airplane in the specific section and which has a fail-safe structure not generating an output at the time of a system or circuit failure or accident.

36 Claims, 12 Drawing Sheets

GROUND GUIDANCE SYSTEM FOR AIRPLANES

DESCRIPTION

This application corresponds to application PCT/JP 87/00367, filed June 9,1987.

TECHNICAL FIELD

The present invention relates to a ground guidance system for airplanes, which safely guides and controls an airplane advancing into a taxiway or present in the taxiway.

BACKGROUND ART

As means for preventing a contact or collision between airplanes on the ground, there has been proposed an airplane ground guidance system in which a taxiway is divided into several continuous sections having a certain length, for example, about 100 m, an airplane-detecting apparatus is arranged in each control section and a subsequent airplane is prevented from advancing in a control section in which an airplane is already present (see Report of Investigation of Airplane Guidance System in Taxiways and Aprons of New Tokyo International Air Port, 1969–1975, by Aviation Promotion Foundation).

According to this system, one rectangular coil loop in which the length of the side parallel to the direction of advance of an airplane is much shorter than the airplane length, for example, 3 to 5 m, is arranged on each of inlet and exit sides of each control section so that the distance between the loop coils on inlet and exit sides is about 90 to about 100 m, the change of the self-inductance caused on passage of an airplane through the loop coil on the inlet side is detected by a sensor and a memory is brought into the set state by a signal of the sensor, whereby an advance-inhibiting lamp indicating the presence of an airplane in the control section is lighted to inhibit a subsequent airplane from advancing in this control section.

When the above-mentioned airplane which has advanced into the control section passes through the loop coil on the exit side, the memory in the set state is reset by an output signal from a corresponding sensor and an advance-admitting lamp indicating the absence of an airplane is lighted, whereby a subsequent airplane is allowed to advance into the control section.

Namely, occurrence of a contact or collision accident on the ground is prevented by allowing only one airplane to be present in one control section Not only airplanes but also various automobiles such as passenger-transporting buses and maintenance vehicles run on the taxiway, and the change of the self-inductance is caused in the loop coil by passage of such a vehicle and a detection output is generated in the airplane-detecting apparatus. Moreover, these automobiles do not always run just on the taxiway but they often cross the taxiway, and there is a good possibility that automobiles pass only on one loop coil on the inlet or exit side.

In this case, in the above-mentioned guidance system in which the memory is set and reset, for example, when an automobile passes on the loop coil on the inlet side even into the absence of an airplane in the control section, the memory is set, and if the memory is not reset, a subsequent airplane is not allowed to advance in the control section. On the other hand, if an automobile passes on the loop coil on the exit side, since the memory into the set state is reset, the advance-admitting lamp is lighted even in the presence of an airplane in the control section, there is a risk of advance of subsequent airplane in the control section. Furthermore, in this control system, the control is established even in case of an automobile which is much smaller than an airplane, and it happens that the control section is occupied by one automobile and the operation efficiency of the taxiway si drastically reduced.

It is a primary object of the present invention to obviate the disadvantages of the above-mentioned system and provide an airplane guidance system in which an airplane is continuously detected in control sections of a taxiway for airplanes, an airplane is discriminated from an automobile by generating different detection patterns and guidance of an airplane is performed safely at a high efficiency.

DISCLOSURE OF THE INVENTION

In accordance with the present invention, the above-mentioned object can be attained by a ground guidance system for airplanes in an airplane taxiway divided in a plurality of control sections, which comprises a plurality of loop coils in which the side parallel to the direction of advance of airplanes has a length larger than the length of an automobile but smaller than the length of an airplane and which are arranged in the direction of advance of airplanes in the control sections at intervals smaller than the length of an airplane, a plurality of airplane-detecting means arranged for the respective loop coils to generate detection outputs indicating the presence or absence of an airplane based on changes of self-inductances of the corresponding loop coils, display means for displaying admission of advance or inhibition of advance in the control sections for an airplane, and control means for controlling said display means based on detection outputs of a plurality of said airplane-detecting means. In this control system, airplane detection signals of two sensors corresponding to adjacent loop coils are always put out in the partially overlapped state and an airplane can be continuously detected. On the other hand, in case of an automobile, detection signals of both the sensors are not overlapped and they become discontinuous, and the detection pattern of an automobile becomes different from the detection pattern of an airplane and they can be discriminated from each other. Therefore, guidance control of an airplane is not influenced by passage of an automobile. Moreover, it does not happen that one control section is occupied by one automobile. Therefore, a system which can guide an airplane safely at high efficiency can be provided.

Furthermore, in the present invention, a memory in which a fail-safe structure cannot be realized need not be used and signal processing is performed in the guidance system by using logical computing means having such a fail-safe structure that no output is generated at the time of a failure, and such a correspondence relation is established between the presence or absence of an airplane in the control section and the output state of the airplane-detecting means that logical value 1 (high voltage) is produced in case of the absence of an airplane and logical value 0 (low voltage including zero) is produced in case of the presence of an airplane. A power source for a driving circuit of an advance-inhibiting signal lamp displaying inhibition of advance in the forward control section is constructed by a constant current power source so that the advance-inhibiting signal lamp is lighted at the time of detection of an airplane or occurrence of a failure, whereby a fail-safe structure can be imparted to the guidance system.

Moreover, the system of the present invention is constructed so that only when the direction indicated by an air traffic controller is in agreement with the advance direction of an airplane, an advance-admitting signal can be generated to set the moving direction of the airplane and bidirectional guidance becomes possible.

Still further, the system of the present invention is constructed so that the guidance control for airplanes can be changed over between manual control and automatic control and if an accident occurs on a taxiway, the movement of an airplane in a specific region of the taxiway or the entire taxiway is inhibited or the airplane is moved according to instructions of an air traffic controller, whereby the accident can be appropriately coped with.

In order to cope with the case where even if the rear end portion of an airplane is left in a loop coil, since the rear end portion is located at a high position and the change of the self-inductance of the loop coil is small, the airplane-detecting means generates a non-detection output, the system of the present invention is constructed so that on condition that no airplane is present in a predetermined loop coil in the rear of the loop coil where an airplane is now present an advance admission signal is produced for a subsequent airplane, whereby the safety is further increased.

Still in addition, the system of the present invention is constructed so that even if one of a plurality of loop coils or airplane-detecting means arranged in one control section gets out of order, guidance of an airplane is maintained by the remaining normal loop coils or airplane-detecting means. In this case, the admission signal lamp should not be lighted before the lighting point at the time when all of the loop coils and airplane-detecting means are normal and the advance-inhibiting signal lamp should not be lighted after the lighting point at the time when all of the loop coils and airplane-detecting means are normal.

BEST MODE FOR CARRYING OUT THE INVENTION

The present invention will now be described in detail with reference to the accompanying drawings.

Figure 1:
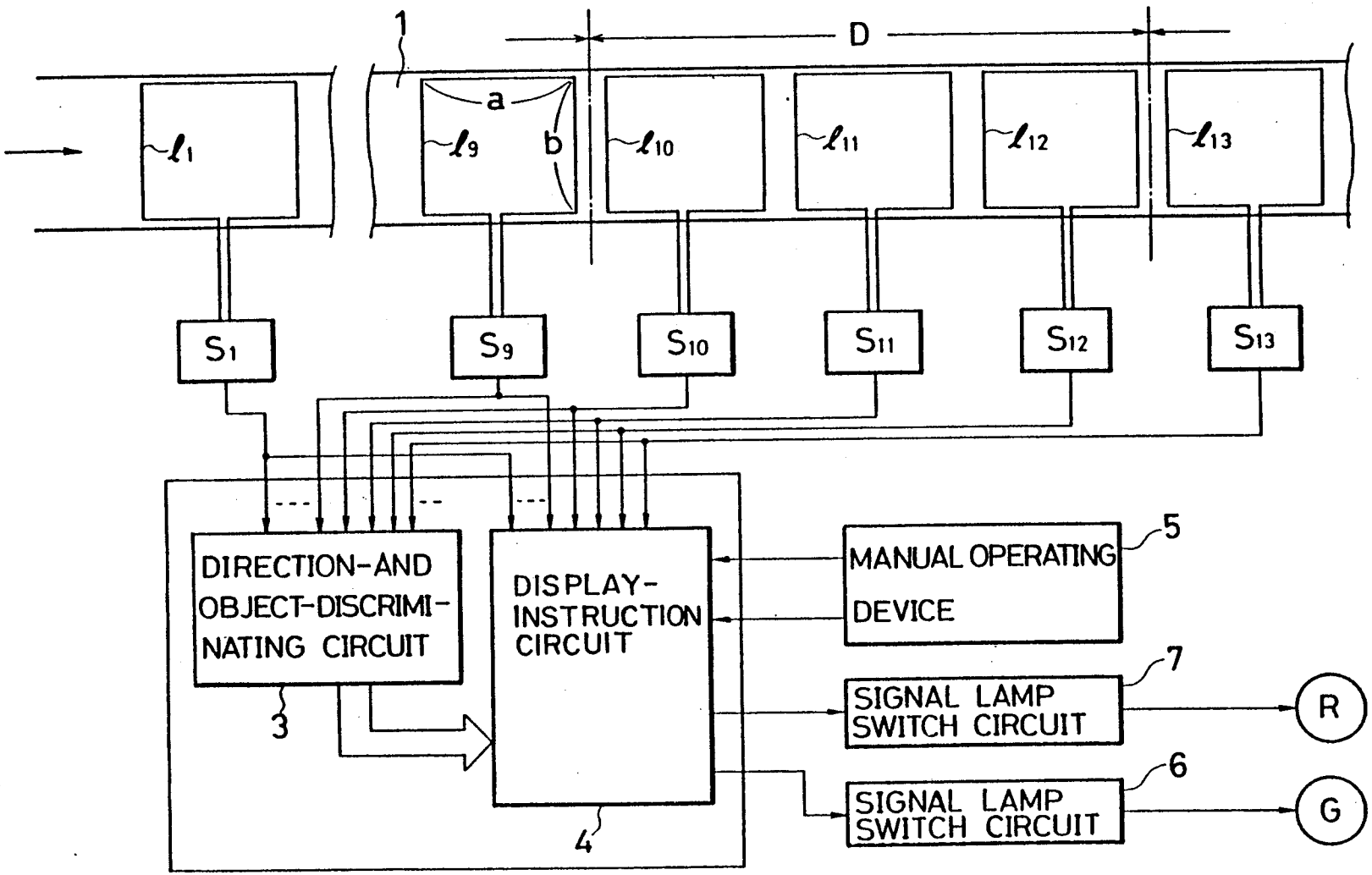
FIG. 1 is a block diagram illustrating one embodiment of the ground guidance system for airplanes according to the present invention.

Referring to FIG. 1, a plurality of loop coils λ i (i=1, 2, ..) are continuously buried in a taxiway 1 at intervals shorter than the length of an airplane along the direction of advance cf an airplane (the direction indicated by an arrow in FIG. 1) in the taxiway 1 for airplanes.

The loop coil 1 has such a rectangular shape that the length of the side a parallel to the direction of advance of an airplane in the taxiway 1 is smaller than the length of an airplane but larger than the length of an automobile, for example, the length of the side, a is 30 m and the side b orthogonal to the side a is 30 m. The taxiway 1 is divided into a plurality of control sections D having a length of, for example, 100 m, and, for example, three loop coils λ i are arranged in each control section D.

In the loop coil λ i, the self-inductance is changed by passage through an airplane, and this change is detected by a sensor Si (i=1, 2, ...) corresponding to the loop coil λ i to put out a signal of detection of the absence or presence of an airplane to a signal processing unit 2 as the control means.

The signal processing unit 2 comprises a direction- and object-discriminating circuit 3, described hereinafter, for detecting the direction of advance of an airplane and discriminating an automobile and a display-instruction circuit 4 and controls signal lamp switch circuits 6 and 7 as signal lamp switch control means for turning on and off a green signal lamp G displaying admission of advance of an airplane into the control section D and a red signal lamp R displaying inhibition of advance based on a detection signal from the sensor Si and an instruction signal from a manual operation device 5 operated by an air traffic controller. If an airplane advances in the control section D from the left in FIG. 1, the self-inductances of loop coils λ 10, λ 11 and λ 12 are changed with advance of the airplane and based on these changes, sensors S10, S11 and S12 put out airplane detection signals sequentially and continuously. While detection signals are put out from the sensors S10 through S12, it is judged that the airplane is present in the control section D and the signal lamp R is lighted to inhibit advance of a subsequent airplane in the control section D. When the airplane in the control section D has advanced into the forward control section completely, a non-detection output is generated from the sensors in the control section D, and when an admission signal is generated from the forward control section, the signal lamp G is lighted to allow advance of a subsequent airplane into the control section D.

Each of the above-mentioned sensors Si, signal processing unit 2 and switch circuits 6 and 7 has a fail-safe structure. Specific circuit structure of these members will now be described.

Each of sensor Si is constructed so that it generates a non-detection output of a high level ( H level ) only when the loop coil λi and the sensors Si are normal and an airplane is not present in the loop coil λi and the sensor Si generates a detection output of a low level (L level) when the loop coil or the sensor gets out of order or an airplane is present in the loop coil.

Figure 2:
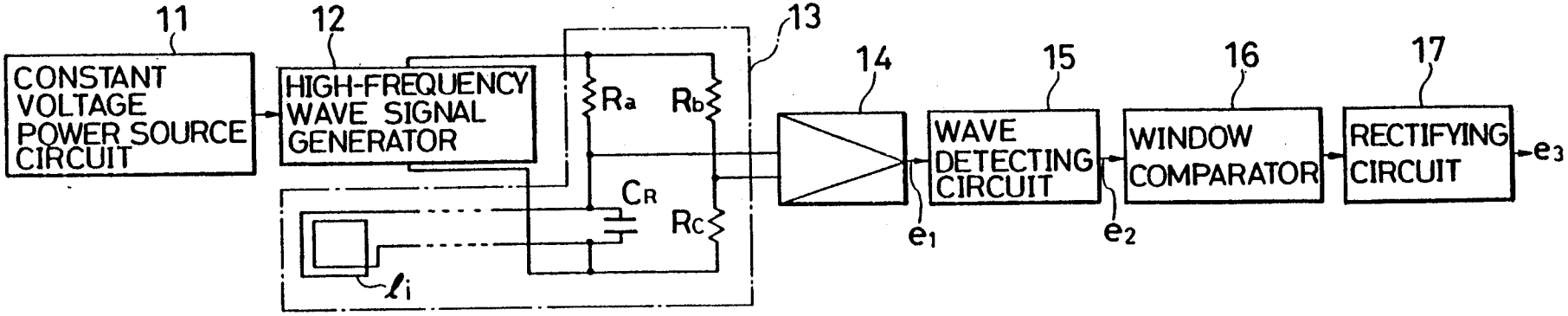
FIG. 2 is a circuit diagram of a sensor in the embodiment shown in FIG. 1.

As shown in FIG. 2, the circuit for the sensor Si comprises a high-frequency signal generator 12 driven by a power supplied from a constant voltage power source circuit 11 to feed a high-frequency current to the loop coil λ i of the taxiway 1, a bridge circuit 13 constructed by resistors Ra, Rb and Rc, the loop coil λ i in the state substantially resonating with the output frequency of the high-frequency signal generator 12 and a capacitor Cr, an alternating current amplifier 14 for amplifying an unequilibriated voltage output of the bridge circuit 13, a wave-detecting circuit 15 for detecting an envelope of an alternating current output signal of the alternating current amplifier 14, a window comparator 16 generating an oscillating output when the output e2 of the wave-detecting circuit 15 is at a level within a specific range (V1<e2<V2 in FIG. 3 ) and a rectifying circuit 17 for rectifying the oscillating output of the window comparator 16.

Figure 3:
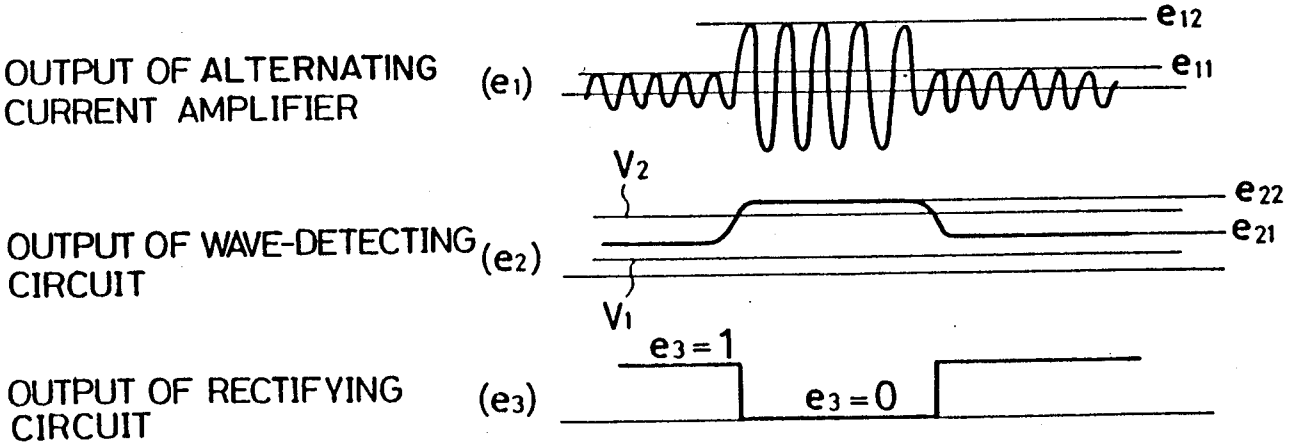
FIG. 3 is a time chart illustrating the operation of the sensor shown in FIG. 2.

When an airplane is not present in the loop coil ( i in the state where a high-frequency electric current is supplied to the loop coil (i from the high-frequency signal generator 12, as shown in FIG. 3, the level of an output el obtained by amplifying the unequilibriated output of the bridge circuit 13 by the alternating current amplifier 14 is ell, and the level of an output e2 of the wave-detecting circuit 15 of the subsequent stage is e21.

Figure 4:
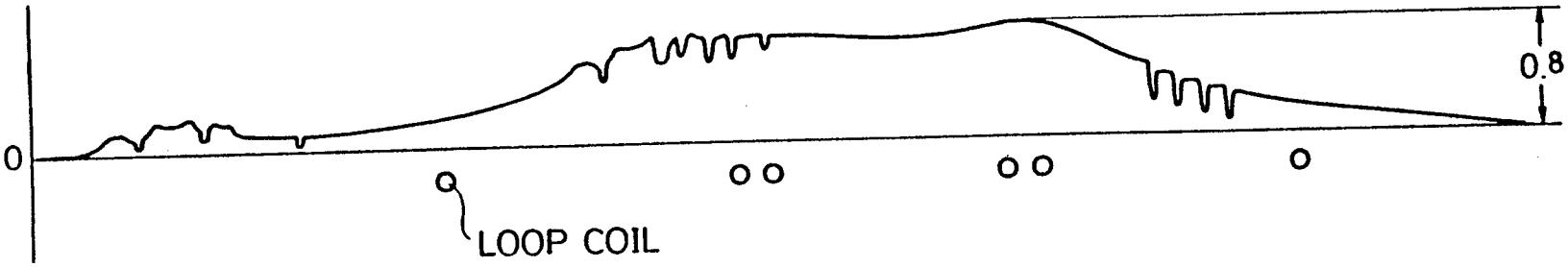
FIG. 4(A) and 4(B) are diagrams illustrating changes of the self-inductance observed when an airplane and an automobile advance in a loop coil, respectively.
Figure 4B:
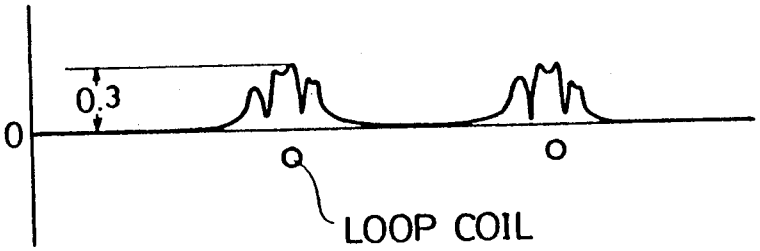

In contrast, when an airplane is present on the loop coil λi, the unequilibriated output of the bridge circuit 13 is increased by the change of the self-inductance of the loop coil λ i and the output level el of the alternating current amplifier 14 is increased to e12, and also the output e2 of the wave-detecting circuit 15 is increased to e22. For example, in case of a loop coil of 30 m×40 m, the amplitude of this change, that is, the induction change ratio, is about 0.8 % at largest for an airplane (FIG. 4(A)) (Boeing 747) and about 0.3 % at largest for an automobile (FIG. 4(B)) (towing car). as shown in FIG. 4.

The window comparator 16 is constructed so that the normal level e21 of the output e2 of the wave-detecting circuit 15 in the absence of an airplane is within the window and the output level e22 in the presence of an airplane is outside the window. Accordingly, when an airplane is not present, oscillation is caused and the rectified output e3 of the rectifying circuit 17 becomes a non-detection output of a high voltage (e3=logical value 1) indicating the absence of an airplane, and when an airplane is present, the oscillation is stopped and the rectified output e3 becomes an airplane-detecting output of a low voltage (e3=logical value 0). If the low-voltage output obtained by stopping the oscillation is thus adopted as the airplane-detecting output inhibiting movement of a subsequent airplane, the airplane-detecting output is made equal to the output at time of a failure such as a circuit failure where no oscillation is caused. Accordingly, the movement of a subsequent airplane is inhibited at the time of a failure to secure safetY. and fail-safe control becomes possible.

The logical product computing oscillation circuit which is the basic circuit constituting the above-mentioned window comparator will now be described with reference to FIG. 5.

This circuit comprises a feedback oscillating portion including two NPN transistors Q1 and Q3, one PNP transistor Q2 and eight resistors R1 through R8, and an amplifying portion including a diode D1, an NPN transistor Q4 and four resistors R9 through R12 (see U.S. Pat. application Ser. No. 725,571 and Japanese Utility Model Application No.59556/84).

The operation of this circuit is as follows.

When an input signal is not applied to input terminals I1 and I2, the transistor Q1 is in the off-state and the transistors Q2 and Q3 are in the on-state, and no oscillating output is produced from an output terminal f. If an input signal of a predetermined level higher than a power source voltage Es is applied to the input terminals I1 and I2 in this state, on-off changeover is repeated in the transistors Q1 through Q3 in a manner as described below to produce an oscillating output on the output terminal f. Namely, through the operation of Q2 off→Q3 off→Q1 on→Q2 on →Q3 on→Q1 off ..., the oscillating output on the collector side of the transistor Q3 is put in the amplifying transistor Q4 through the diode D1 to produce an oscillating output from the output terminal f.

The input signal conditions for generating an oscillating output are substantially represented by the following formulae.

$$VI1 > \frac{R1 + R2 + R3}{R3} Es \quad (1)$$

$$Es < VI2 < \frac{R6 + R7}{R7} Es \quad (2)$$

wherein VI1 and VI2 respectively stand for input voltages of the input terminals I1 and I2.

Accordingly, this circuit is an AND gate which oscillates only when an input of a predetermined level higher than the power source voltage Es is applied to the input terminals I1 and I2. If the input terminals I1 and I2 are made common as indicated by a dot line in FIG. 5, oscillation is caused at a logical product of both the input voltages VI1 and VI2, the conditions for the oscillation input voltage VI (=VI1=VI2) are expressed by the following formula:

$$\frac{R1 + R2 + R3}{R3} Es < VI < \frac{R6 + R7}{R7} Es \quad (3)$$

Figure 5:
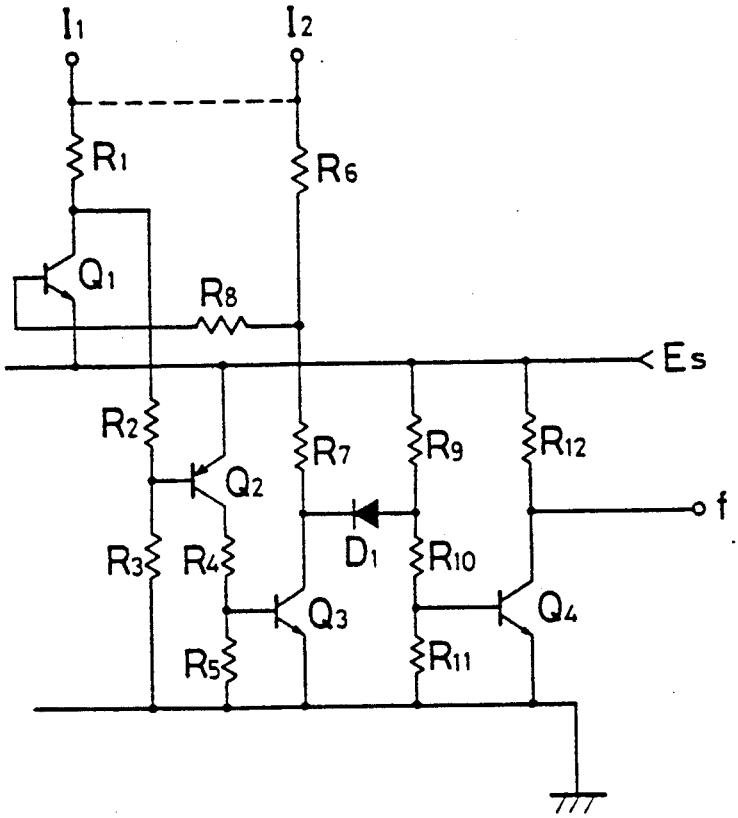
FIG. 5 is a circuit diagram of a logical product computing oscillator as a constituent element of a window comparator of the sensor shown in FIG. 2.

As is seen from the foregoing illustration, if both the input terminals I1 and I2 are made common, the logical product computing oscillation circuit shown in FIG. 5 becomes a window comparator as shown in FIG. 2, and an oscillating output is generated only when the input signal level is within the range defined by the formula (3). Incidentally, the input voltage range (window) defined by the formula (3) can be changed according to values of the resistors constituting the circuit.

Since the above-mentioned circuit does not generate an oscillating output at the time of a failure, the circuit has such a characteristic that an output signal is not erroneously generated in the absence of the input signal, that is, a fail-safe characteristic.

Figure 6:
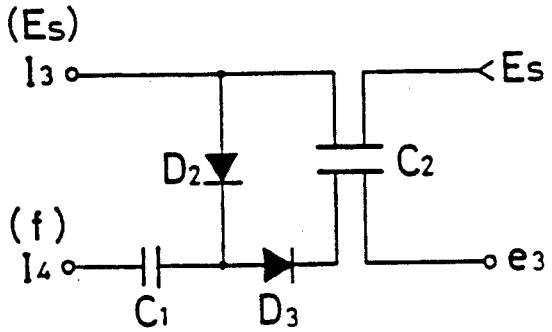
FIG. 6 is a circuit diagram of a rectifying circuit in the sensor shown in FIG. 2.

The rectifying circuit 17 shown in FIG. 2 is a voltage-multiplying rectifier clamped at the power source voltage Es by a diode D2 shown in FIG. 6, and terminals 13 and 14 are connected to the power source line Es and output terminal f shown in FIG. 5, respectively. Only when the window comparator 16 oscillates, the level of the rectified output e3 becomes higher than the power source voltage Es, and when the window comparator 16 does not oscillate or the rectifying circuit 17 gets out of order, a rectified output of a level higher than the power source voltage Es is not produced.

If the circuit system is set so that the normal output e21 (the absence of an airplane) of the wave-detecting circuit 15 is included within the range defined by the formula (3) and the output e22 in the presence of an airplane is outside this range,. output characteristics as shown in FIG. 3 are given to the sensor Si. The window comparator 16 and rectifying circuit 17 have the above-mentioned fail-safe characteristics and the high-frequency signal generator 12, alternating current amplifier 14 and wave-detecting circuit 15 can be realized by using known fail-safe structures in which no output is generated at the time of a trouble. Moreover, if a failure such as breaking or formation of a short circuit is caused in the resistors Ra, Rb and Rc, capacitor CR and loop coil λ i constituting the bridge circuit 13, the unequilibriated output of this circuit is drastically increased and the level of the output e2 of the wave-detecting circuit 15 is outside the window of the window comparator 16. Accordingly, the sensor Si having the structure shown in FIG. 2 has fail-safe characteristics.

The structure of the signal processing unit will now be described.

Figure 7:
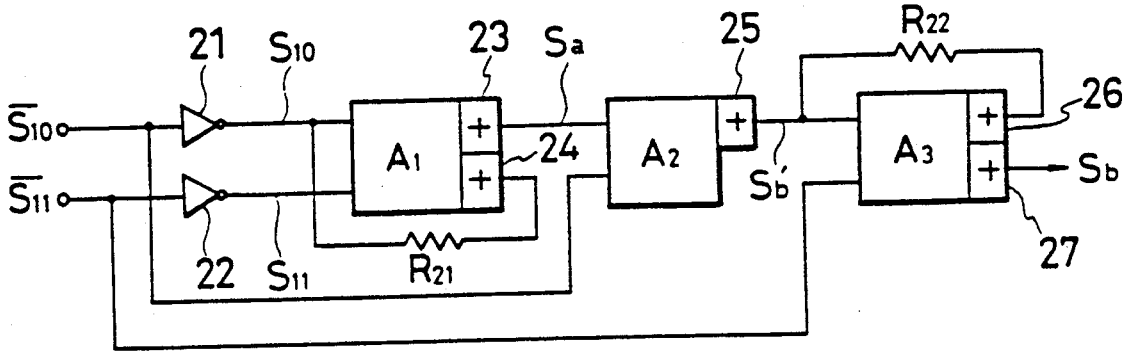
FIG. 7 is a circuit diagram of a direction- and object-discriminating circuit in the embodiment shown in FIG. 1.

The direction- and object-discriminating circuit 3 for discriminating the direction of an airplane and a moving object (airplane or automobile) comprises, as shown in FIG. 7, first through third AND gates A1, A2 and A3 constructed by NOT computing circuits 21 and 22 by the above-mentioned window comparator and the logical product computing oscillation circuit shown in FIG. 5, respectively, rectifying circuits 23 through 27 having a structure as shown in FIG. 6, a first self-retention circuit for feeding back a rectified output of the first AND gate Al through a feedback resistor R21 to the input terminal in which the output of the sensor S10 corresponding to the loop coil (10 located on the inlet side of the control section of the first AND gate Al, in which the outputs of the sensors S10 and S11 connected to adjacent loop coils λ 10 and λ 11 are put, and a second self-retention circuit for feeding back a rectified output of the third AND gate A3 through a feedback resistor R22 to the input terminal in which an output of the second AND gate A2 is put.

The output Si (the rectified output e3 of the rectifying circuit 17) of the sensor Si put in the NOT computing circuits 21 and 22 is an output of a negative signal (denial mode for detection) which is at an H level on non-detection of an airplane and at an L level on detection of an airplane. Accordingly, the output signal of the sensor Si is designated as $\overline{Si}$, and $\overline{Si}$ is equal to 0 when an airplane is detected and $\overline{Si}$ is equal to 1 when an airplane is not detected.

FIG. 7 illustrates the case where, supposing that an airplane moves in the direction of from the loop coil (10 to the loop coil λ 11, the movement of an airplane is detected by output signals $\overline{S10}$ and $\overline{S11}$ of the sensors S10 and S11.

This operation will now be described with reference to a time chart.

Figure 8:
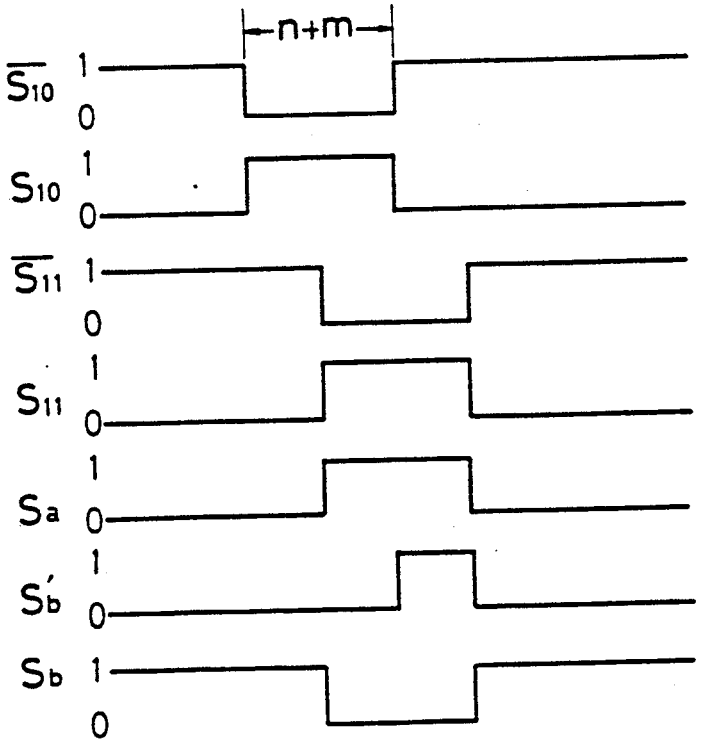
FIG. 8 is a time chart illustrating the operation of the direction and object-discriminating circuit shown in FIG. 7.

The section for detection of an object by each of the loop coils λ 10 and λ 11 is the sum (n+m) of a detection effective section n (n<a) of the loop coil λ 10 determined by a threshold value (detection level) set by the sensor S10 and the length m of the floor face of an airplane effective for detection. Since the interval between the loop coils λ10 and λ11 is much smaller than the length of an airplane, the detection outputs $\overline{S10}$ and $\overline{S11}$ by the loop coils λ10 and λ11 are generated in the partially overlapped state as shown in FIG. 8. Incidentally, in FIG. 8, output signals S10 and S11 are NOT signals to the output signals $\overline{S10}$ and $\overline{S11}$.

The detection outputs $\overline{S10}$ and $\overline{S11}$ of the sensors S10 and S11 are put in the AND gate Al through the NOT computing circuits 21 and 22. If the movement of an airplane is detected by the sensor S10, the detection output $\overline{S10}$ becomes "0" and the input signal S10 of the first AND gate Al becomes "1". If the airplane-detecting output ($\overline{S11}=0$) is generated from the subsequent sensor in this state, the other input signal S11 of the first AND gate Al becomes "1", and the first AND gate Al oscillates. When a rectified output Sa from the rectifying circuit 23 is applied to one input terminal of the second AND gate A2, the input signal S11 of the first AND gate Al is self-retained through the resistor R21 by the output of the rectifying circuit 24 while the airplane is detected.

The second AND gate A2 oscillates when the airplane-detecting signal ($\overline{S10}=0$) of the sensor S10 disappears, and the second AND gate A2 generates a direction-detecting output-generating output Sb' as a rectified output of the rectifying circuit 25. This output Sb' is put in the subsequent third AND gate A3 and is self-retained through the resistor R22 by a rectified output of the rectifying circuit 26 on extinction of the detection output of the sensor S11 ($\overline{S11}=1$), and this output Sb' is kept generated while the non-detection output ($\overline{S11}=1$) of the sensor S11 is generated from the rectifying circuit 27 of the third AND gate A3, whereby the output Sb' is put out from the direction- and object-discriminating circuit 3 as a direction detection output Sb indicating that the airplane moves to the loop coils 11 from the loop coil λ10.

In the circuit shown in FIG. 7, when an airplane moves in the reverse direction and the detection output signals are put out in order of $\overline{S11}\rightarrow\overline{S10}$, the first AND gate Al is not self-retained, and when the output of the first AND gate Al disappears, since the sensor S10 still generates the detection output ($\overline{S10}=0$), the direction detection output-generating output Sb' is not generated from the second AND gate A2 and the direction-detecting output Sb is not generated from the third AND gate A3 (Sb=0) Furthermore, any of the NOT computing circuit 21 and 22, first through third AND gates Al through A3 and rectifying circuits 23 through 27 does not generate an output when a failure occurs. When failure is caused in the feedback resistors R21 and R22, the self-retention is not effected, and therefore, a continuous direction detection output is not produced.

Accordingly, this direction- and object discriminating circuit 3 has such a fail-safe structure that a detection output is erroneously generated.

In case of an automobile which is shorter than the coil side a of the loop coil λ i, a detection signal is generated only in the vicinity of the side of the loop coil, and if the interval between adjacent loop coils is longer than the automobile, the detection outputs $\bar{S}10$ and $\bar{S}11$ from the sensors S10 and S11 are not produced in the overlapped state and if the adjacent loops are located in the same place, the outputs simultaneously disappear. Accordingly, any direction-detection output is not generated. Thus, the loop coils respond only to an airplane but do not respond to an automobile, and therefore, discrimination is possible between an airplane and an automobile.

The display-instructing circuit 4 for generating a signal of admission of advance in the control section and a signal of inhibition of advance will now be described with reference to FIG. 9.

If an accident takes place on the taxiway 1, it is necessary that use of the entire taxiway 1 should be inhibited or an airplane should be guided by instructions of an air traffic controller (manual operation). In view of this fact, the display-instructing circuit 4 shown in FIG. 9 is provided with a manual mechanism.

A changeover switch SW1 of a manual operation device 5 is normally connected to a contact C1 to give admission of advance on the taxiway 1, and when an accident occurs, the switch SW1 is connected to a contact C2 to cancel admission of advance and give an inhibition signal for inhibiting advance in all of control sections or specific control sections, and this changeover switch S1 acts as a cancel switch for cancelling all of the operations of switches SW2 through SW4 described hereinafter. The switch SW2 is a direction-setting switch for setting the advance direction of an airplane by an air traffic official. The switch SW3 is a changeover switch for selecting automatic control (contact C3) or manual control (contact C4)for the guidance of an airplane when admission of advance is given by the changeover switch SW1. The switch SW4 is a manual advance-admitting instruction switch for giving an advance-admitting instruction signal appropriately by the air traffic controller when the manual control is selected by the switch SW3.

In the display-instructing circuit 4, when admission of advance in the taxiway is given and the direction instructed by the air traffic controller is in agreement with the direction detection signal Sb from the direction- and object-discriminating circuit 3, an output is generated from a fourth AND gate A4 through a rectifying circuit 31. If the switch SW3 is connected to the contact C3 at this point, the automatic operation is selected and an advance-admitting signal is automatically put in a fifth AND gate A5, and if the switch SW3 is connected to the contact C4, the manual operation is selected and if the switch SW4 is turned on at the will of the air traffic controller, an advance-admitting signal is put in the fifth AND gate A5, whereby an admission signal fl to a control section (control section D shown in FIG. 1) in the rear of the control section through which an airplane is now advancing (the control section on the forward side of the control section D shown in FIG. 1) is generated from the fifth AND gate A5 through a rectifying circuit 32 and this signal is applied to one input terminal of an AND gate A8 as advance admission-instructing means. Namely, advance-admitting signal-generating means is constructed by the fourth and fifth AND gates A4 and A5 and the rectifying circuits 31 and 32.

If an airplane-detecting signal is not generated from any of the sensors S10, S11 and S12 corresponding to the loop coils λ 10, λ 11 and λ 12 in the control section D ($\bar{S}10=\bar{S}11=\bar{S}12=0$), an output f2 of an AND gate A6 is converted to a non-inhibition signal of a high voltage through a rectifying circuit 33 by the output generated through a rectifying circuit 34 of an AND gate A7 and this non-inhibition signal is applied to the other input terminal of the AND gate A8, whereby an advance-admitting display-instructing signal f3 of a high voltage is generated from the AND gate A8 to light the signal lamp G and admit advance in the control section D.

Namely, the signal f3 for instructing display of admission of advance in the control section D is generated only when the direction of advance is in agreement with the direction instructed by the air traffic controller to generate the direction-detection signal in the control section on the forward side of the control section D and an airplane is not present in the control section D.

Incidentally, if an airplane is present in the control section D, a detection output ($\bar{S}10$, $\bar{S}11$, or $\bar{S}12=0$) is generated from any of the sensors S10, S11 and S12, and therefore, the output f2 from the AND gate A6 becomes an advance-inhibiting signal of a low level and the advance-admitting display-instructing signal f3 of the AND gate A6 is not generated, and simultaneously, the advance-inhibiting signal lamp R is lighted to inhibit advance in the control section D. A sixth AND gate is constructed by the AND gates A6 and A7, and the advance-inhibiting signal-generating means is constructed by the AND gates A6 and A7 and, the rectifying circuits 33 and 34.

When an accident occurs on the taxiway 1, the switch Sw1 is changed over to the contact C2 to generate an advance-inhibiting signal for all of the control sections or specific control sections. Since any of the AND gates A4 through A8 does not generate an output at the time of a trouble or accident, an advance-admitting signal of a high voltage is not produced at all and a fail-safe effect is attained. Incidentally, in the case where bidirectional advance of airplanes is carried out, another circuit of a similar structure is disposed for the other advance direction.

When an airplane does not pass, as just after changeover of the direction of guidance of an airplane, no direction detection signal is generated. However, as is obvious to those skilled in the art, a signal f3 for instructing display of admission of advance in the control section D can be generated by forming wired OR connection between a non-inhibition signal f4 generated from the non-detection signals of the respective sensors of said control section and an admission signal fl generated by a manual switch SW5 indicated by a dot line in the drawings.

Figure 10:
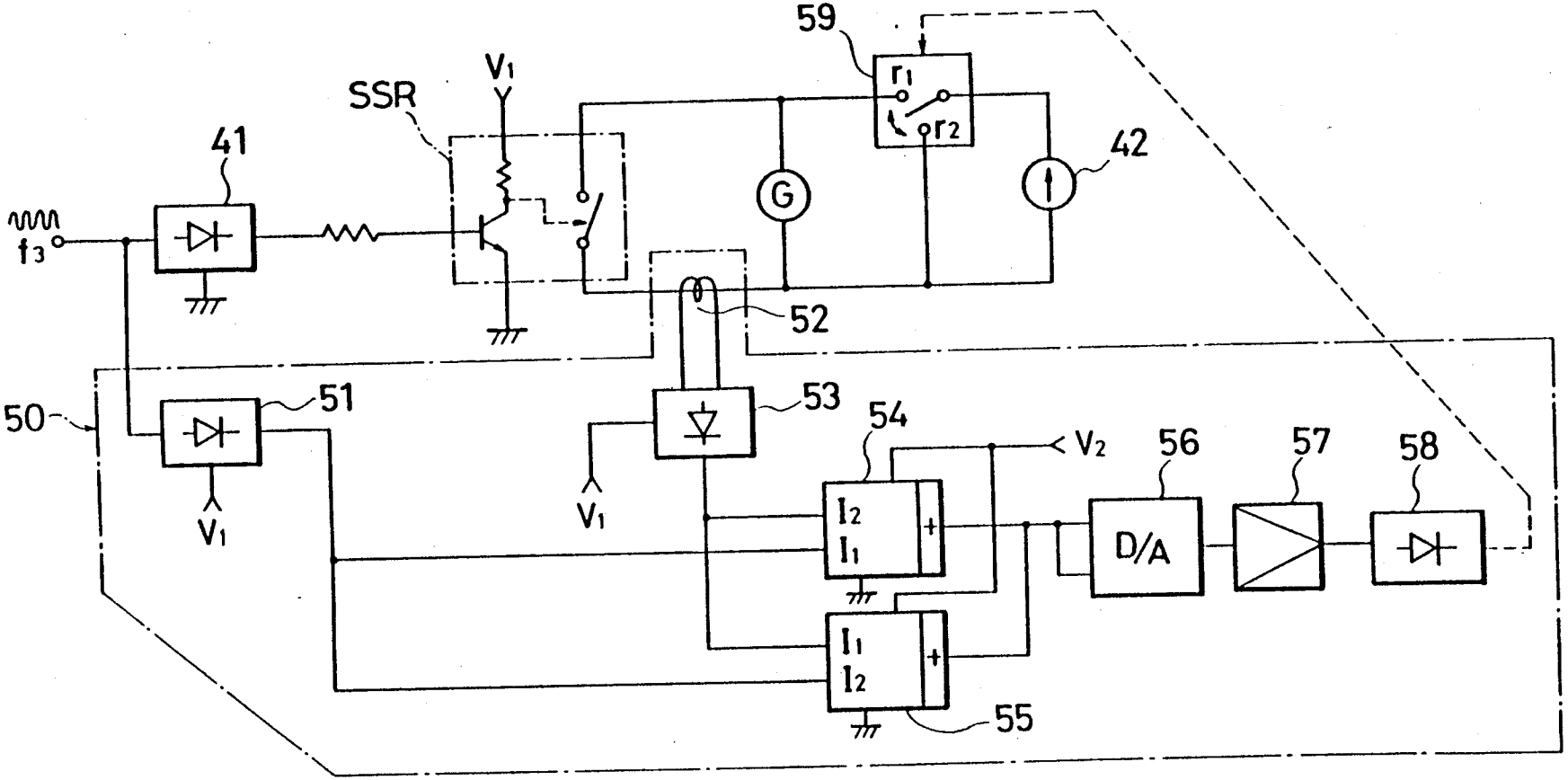
FIG. 10 is a diagram illustrating a switch circuit for an admission signal lamp in the embodiment shown in FIG. 1.
Figure 12:
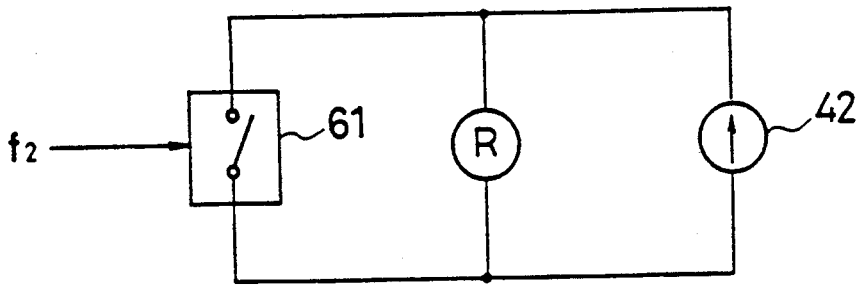
FIG. 12 is a diagram illustrating a switch circuit for an inhibition signal lamp.

FIGS. 10 and 12 illustrate switch circuits 6 and 7 of the admission signal lamp G and inhibition signal lamp R in which the advance-admitting display-instructing signal f3 and advance-inhibiting signal f2 from the display-instructing circuit 4 are put, respectively.

The admission signal lamp circuit 6 will now be described.

In the admission signal lamp switch circuit 6, a solid state relay (hereinafter referred to as "SSR") is used as the switch element, and at the time of a failure, SSR shows both the switch states of breaking (OFF) and short circuit (ON) seen from the output side. Accordingly, there is a risk of displaying an admission signal or an inhibition signal according to the kind of the failure, and especially, display of the admission signal results in collision of airplanes. Accordingly, erroneous display of the admission signal at the time of a failure should be avoided.

Accordingly, in the admission signal lamp switch 6, a watch circuit 50 surrounded by a chain line in FIG. 10 is arranged to inspect whether or not SSR is normally operated and cut off the power source of the signal lamp G at the time of a failure.

Figure 9:
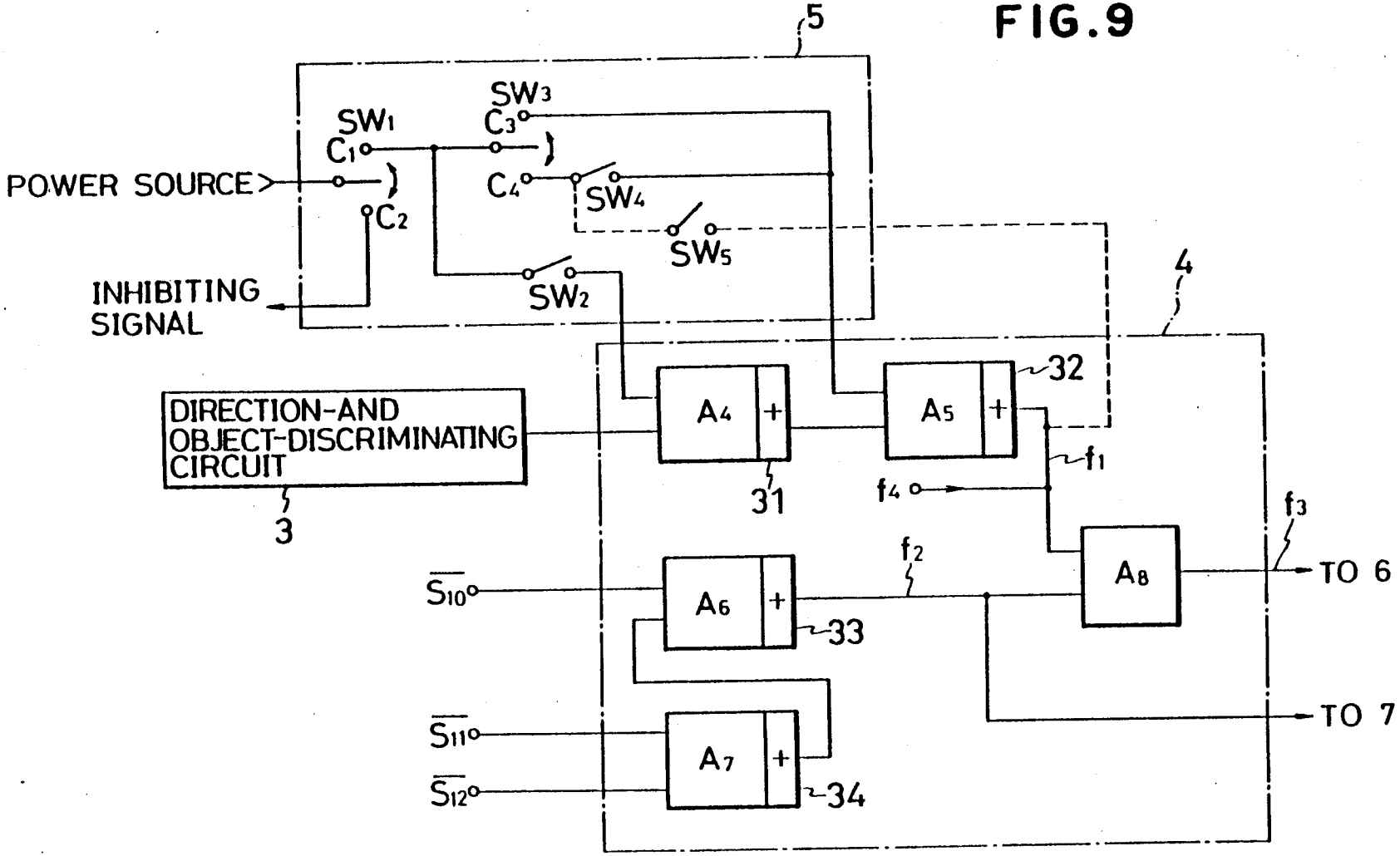
FIG. 9 is a diagram illustrating the structure of a display-instructing circuit in the embodiment shown in FIG. 1.

Referring to FIG. 10, a rectifying circuit 41 rectifies the advance-admitting display-instructing signal f3 from the AND gate A8 shown in FIG. 9 and supplied the rectified output to SSR performing switching of the signal lamp G. In general, SSR is turned off when an input signal of a high voltage is applied, and SSR is turned on when an input signal of a low voltage is applied. Incidentally, a constant current power source 42 is generally used as the power source for the signal lamp G.

The watch circuit 50 for inspecting the operation state of SSR comprises a rectifying circuit 51 for generating a rectified output formed by overlapping a direct current voltage V1 on the advance-admitting display-instructing si f3, a rectifying circuit 53 for generating a rectified output formed by overlapping the direct current voltage V1 on the output of a current sensor 52 as the current detecting means for detecting the presence or absence of the output current of SSR, AND gates 54 and 55 having a window comparator function of comparing logically the values of the outputs of both the rectifying circuits 51 and 53, which oscillate when the input-output relation is normal, a D/A converter 56 constituted by the AND gate similar to the one shown in FIG. 5 for converting a wired OR output (digital) of both the AND gates 54 and 55 to an analogue output, an alternating current amplifier 57, and a rectifying circuit 58 for rectifying the alternating current amplified output, and the watch circuit 50 controls the driving of an electromagnetic relay 59 as the current cut-off means for performing the on-off control of the constant current power source 42 and signal lamp G by the rectified outputs.

The operation of the watch circuit 50 will now be described.

The relation between the input signal (advance-admitting display-instructing signal f3) and the output signal (output current of SSR) in the normal state where the electromagnetic relay 59 is connected to a contact r1 is such that when the input is "1", the output is "0" and when the input is "0", the output is "1". Namely, when the input is "1", the contact of SSR is turned off to light the signal lamp G, and when the input is "0", the contact of SSR is turned on to put out the signal lamp G by formation of a short circuit.

When the input signal f3 from the AND gate A8 is supplied, the output overlapped with the voltage V1 from the rectifying circuit 51 is applied to the input terminal I1 of the AND gate 54 and the input terminal I2 of the AND gate 55. Furthermore, the rectified output formed by overlapping the voltage V1 on the output of the electric current sensor 52 is applied to the other input terminals I2 and I1 of the AND gates 54 and 55. The power source voltage V2 of both the AND gates 54 and 55 is set at a level lower than the overlapped voltage V1 in the rectifying circuits 51 and 53.

The AND gate 54 oscillates when the input signal is "1" 55 oscillates when the input signal is "0" and the output of the current sensor is "1". The AND gates 54 and 55 does not generate an oscillation output in any of the other input-output relations.

Accordingly, supposing that the voltages attained when the input signal and the output signal of the current sensor are logical value 1 (high voltage) are Vf and Vs, respectively, the oscillation condition for the AND gate 54 on the side of the input terminal I1 is expressed by the following formula:

$$V1 + V_f > \frac{R1 + R2 + R3}{R3} V2 > V1 \quad (4)$$

and the oscillation condition for the AND gate 54 on the side of the input terminal I2 is represented by the following formula:

$$V2 < V1 < \frac{R6 + R7}{R7} V2 < V1 + V_s \quad (5)$$

The oscillation condition for the AND gate 55 on the side of the input terminal I1 is represented by the following formula:

$$V1 + V_s > \frac{R1 + R2 + R3}{R3} V2 > V1 \quad (6)$$

and the oscillation condition for the AND gate 55 on the side of the input terminal I2 is represented by the following formula:

$$V2 < V1 < \frac{R6 + R7}{R7} V2 < V1 + V_f \quad (7)$$

In short, the logical sum (wired OR) output of the AND gates 54 and 55 becomes logical value "1" only when the input-output relation is normal.

Accordingly, the D/A converter 56 generates an oscillating output only when the input-output relation is normal, and this output is amplified by the alternating current amplifier 57 and rectified by the rectifying circuit 58. By the rectified output, the electromagnetic relay 59 is excited to close the contact r1. Accordingly, only in the normal state, the signal lamp G is put on and off by the admission signal lamp switch circuit according to the on-off state of SSR. At the time of a failure or accident, the electromagnetic relay 59 is not excited and the signal lamp G is not lighted. Since the watch circuit 50 has a fail-safe structure and does not generate an output at the time of a failure, erroneous lighting of the admission signal lamp G by a failure in the watch circuit 50 is prevented.

Incidentally, the watch circuit 50 detects occurrence of a failure when the input signal is "0" and the sensor output signal is "0", but if the input signal is then changed to "1" while the sensor output signal is maintained at "0", the input-output relation becomes equal to the normal input-output relation and judgement of the failure is cancelled.

Figure 11:
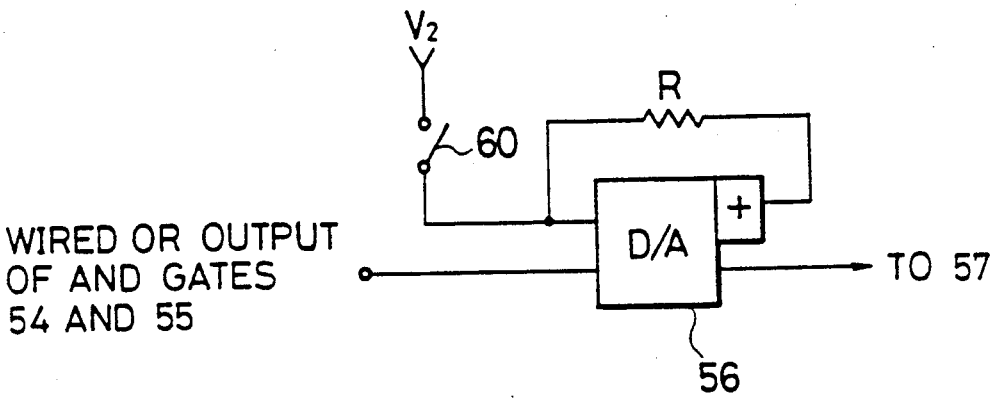
FIG. 11 is a circuit diagram illustrating the structure of a main part of another embodiment of the admission signal lamp.

In order to prevent occurrence of this phenomenon, there may be adopted, for example, a structure in which, as shown in FIG. 11, a presettable self-retention circuit is disposed as the D/A converter 56 (in this case, the D/A converter acts as an AND gate), and if a normal signal is generated by the on-operation of a preset switch 60 the normal signal is self-retained and stored by a feedback resistor R even after the off-operation of the switch 60 and if the oscillaton of the D/A converter 56 is stopped at the time of a failure and the self-retention is reset, the normal signal is not put out unless the preset switch 60 is turned on again.

An inhibition signal lamp switch circuit (signal lamp switch circuit 7 in FIG. 1) shown in FIG. 12 is provided with SSR 61 as a switch element which is turned on when the output of the AND gate A6 shown in FIG. 9 is at the H level and is turned off when the output of the AND gate A6 is at the L level, and the inhibition signal lamp R is connected to this switch circuit in parallel to SSR 61. A constant current power source 42 resembling the power source circuit for the admission signal lamp G is used as the power source. The operation of this circuit will now be described.

If, for example a detection signal (L level) is generated from any one of the sensors S10, S11 and S12 in the control section D, the output of the AND gate is turned to an L level, whereby SSR 61 is turned off and the inhibition signal lamp R is lighted. If any of the sensors S10, S11 and S12 does not generate a detection signal and an airplane is not present in the control section D, the non-inhibition signal f2 of an H level is generated from the AND gate A6 and SSR 61 is turned on, whereby the inhibition signal lamp R is put off by formation of a short circuit.

Special cares should be taken in the guidance control for guiding airplanes safely.

Since the rear end portion of an airplane is located at a high position, even if the rear end portion does not completely separate from the loop coil λ i but is left in the loop coil λi region, the change of the self-inductance is small and the sensor output becomes a non-detection output. The first concern is to cope with this phenomenon.

Figure 13:
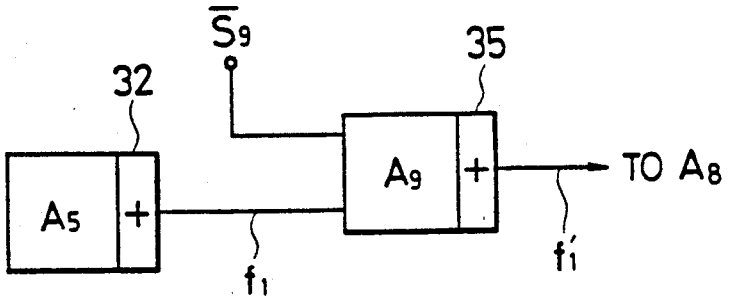
FIG. 13 is a circuit diagram illustrating another embodiment of the display-instructing circuit.

For example, referring to FIG. 1, if an airplane advances in the control section D and passes through the loop coils λ 10 and λ11, the advance-admitting signal fl to the rear control section is generated at the time point when the non-detection signal ($\overline{S11}=1$) of the sensor S11 is generated. However, as pointed out hereinbefore, there is a possibility that the rear end portion of the airplane is still present in the loop coil (11. An AND gate A9 for computing the logical product of the rectified output of the AND gate A5 and the output S9 of the sensor $\overline{S9}$ is disposed precedently to the AND gate A8, as shown in FIG. 13, so that while admitting that an airplane is apparently absent on the loop coil λ9 in the rear of the loop coil (11, the advance-admitting signal fl is produced only when the non-detection output ($\overline{S9}=1$) is generated in the sensor S9 of the loop coil λ9, and the output signal f1' of the AND gate 9 is adopted as the advance-admitting signal to increase the safety.

Another concern is for guidance control at the crossing point of taxiways.

Figure 14A:
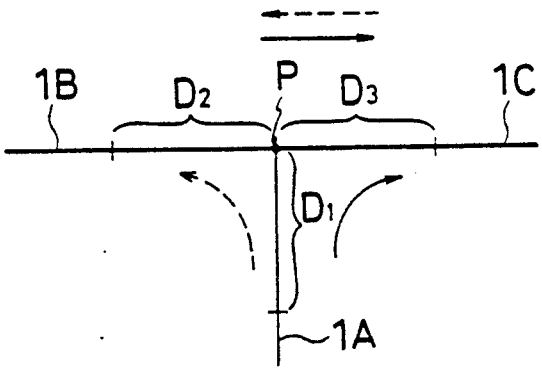
FIGS. 14(A), 14(B) and 14(C) are diagrams illustrating the control system for different airplane running patterns at the crossing point of taxiways in the embodiment shown in FIG. 1.
Figure 14B:
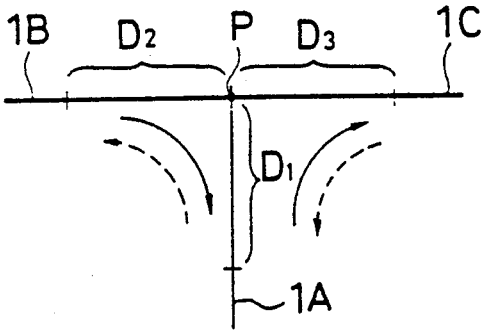
Figure 14C:
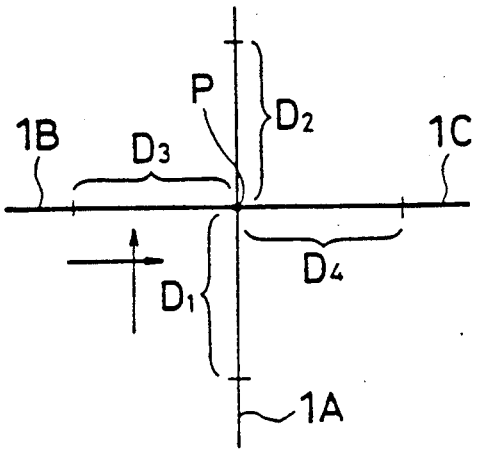

FIGS. 14(A), 14(B) and 14(C) show different running patterns at the crossing point P. Namely, FIG. 14(A) shows the case where the direction of an airplane in a taxiway 1A is set so that the airplane joins with a stream of airplanes running from a taxiway 1B to a taxiway 1C or from the taxiway 1C to the taxiway 1B, FIG. 14(B) shows the case where a direction-admitting signal is necessary for running of an airplane in a taxiway 1A where advance in a taxiway 1B or 1C from the taxiway 1A and advance in the taxiway 1A from the taxiway 1B or 1C are carried out, and FIG. 14(C) shows the case where two taxiways 1A and 1B cross each other.

In the case where an airplane advances in control section D1, D2, D3 and D4 extending from the crossing point, it is required that an airplane should not be present on the crossing point P and furthermore, even a wing of the plane should not be present on the crossing point P. Accordingly, in this case, the condition for admission of advance is that an airplane should not be present on the crossing point P and in any of control sections D1, D2, D3 and D4 adjacent to the crossing point P.

Therefore, a logical product output of outputs $\overline{P}$, $\overline{D1}$, $\overline{D2}$, $\overline{D3}$ and $\overline{D4}$ of sensors at the crossing point P and the control sections D1 through D4 ($\overline{P}=\overline{D1}=\overline{D2}=\overline{D3}=\overline{D4}=0$ at the time of detection of an airplane) is put in the AND gate A9 instead of $\overline{S9}$ shown in FIG. 13 in the control sections adjacent to the crossing point P.

When a failure is caused in sensors or loop coils, the signals $\overline{P}$, $\overline{D1}$, $\overline{D2}$, $\overline{D3}$ and $\overline{D4}$ are erroneously set at 0, and therefore, an advance admission signal is not generated and a fail-safe structure is realized.

If the guidance control system is constructed so that an airplane is continuously detected by loop coils (i arranged continuously in a taxiway 1 as described hereinbefore, the presence or absence of an airplane in the control sections can always be detected without using a memory, and safe guidance of airplanes can be realized. Since the sensor output patterns of an airplane and an automobile are made different from each other according to the shape and arrangement structure of the loop coils, an erroneous operation owing to passage of an automobile can be prevented, and since a low level (including an output of zero) signal is used as the airplane detection signal instead of the customarily adopted detection signal and this signal errs to an inhibition signal on occurrence of a failure in the control system, a fail-safe structure is realized and guidance of airplanes can be controlled with a very high safety.

An embodiment in which advance-admitting and advance-inhibiting signals are redundantly obtained will now be described.

In the ground guidance system of the present invention, since the sensor Si of the loop coil (i detects a small change of a signal, the reliability is generally low. Accordingly, the reliability of this guidance control system depends greatly on the reliability of the sensor Si including the loop coil λi. The redundant control for increasing the reliability of the sensor Si will now be described.

The redundant control of generation of advance-admitting signals is first described.

Figure 15:
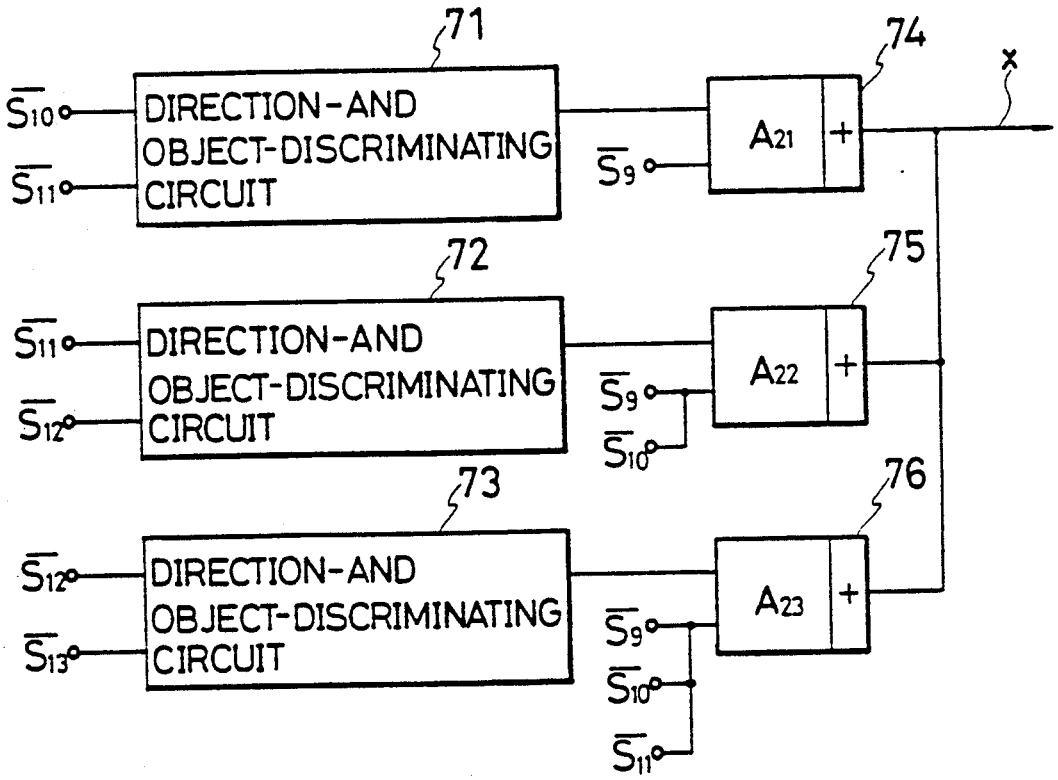
FIG. 15 is a diagram illustrating a direction- and object-discriminating signal-generating circuit having a redundant function.

FIG. 15 illustrates a direction- and object-discriminating signal-generating circuit for redundantly obtaining a direction- and object-discriminating signal for obtaining an admission of advance by output signals $\overline{S10}$, $\overline{S11}$ and $\overline{S12}$ from the sensors S10 through S12 in the control section D shown in FIG. 1.

In FIG. 15, direction- and object-discriminating circuits 71, 72 and 73 have a structure shown in FIG. 7, and the outputs $\overline{S10}$ and $\overline{S11}$, the outputs $\overline{S11}$ and $\overline{S12}$, and the output $\overline{S12}$ and the sensor output $\overline{S13}$ of the subsequent control section are used as input signals of the circuits 71, 72 and 73, respectively. As an airplane runs in the control section D, the direction- and object-discriminating circuits 71, 72 and 73 sequentially generate direction-object discrimination output signals. The direction- and object-discriminating circuits 71, 72 and 73 are constructed so that these direction-object discrimination signals are transmitted to the circuit of the subsequent stage for the first time when at least the sensor located ahead, in the direction of advance, of the sensors generating input signals for the direction- and object-discriminating circuits 71, 72 and 73 generates a non-detection output. Namely, the output signal of the direction- and object-discriminating circuit 71 is transmitted to the circuit of the subsequent stage through an AND gate A21 and a rectifying circuit 74 when the output $\overline{S9}$ of the sensor S9 corresponding to the loop coil λ 9 is changed to a non-detection output ($\overline{S9}=1$), and the output signal of the direction- and object-discriminating circuit 72 is transmitted to the circuit of the subsequent stage through an AND gate A22 and a rectifying circuit 75 when the output $\overline{S9}$ or $\overline{S10}$ of one of the sensors S9 and S10 is changed to a non-detection signal ($\overline{S9}$ or $\overline{S10}=1$). Furthermore, the output signal of the direction- and object-discriminating circuit 73 is transmitted to the circuit of the subsequent stage through an AND gate A23 and a rectifying circuit 76 when the output $\overline{S9}$, $\overline{S10}$ or $\overline{S11}$ of one of the sensors S9, S10 and S11 is changed to a non-detection output ($\overline{S9}$, $\overline{S10}$ or $\overline{S11}=1$). These outputs are converted to one direction-object discrimination signal x by wired OR.

Accordingly, the direction-object discrimination signal x is generated when it passes through the sensor S12 in the case where the sensor S9 gets out of order, when it passes through the sensor S12 in the case where the sensor S10 gets out of order, when it passes through the sensor S13 in the case where the sensor S11 gets out of order and when it has already passed through the sensor S11 by the direction- and object-discriminating circuit 71 in the case where the sensor S12 gets out of order.

Namely, in the direction- and object-discriminating signal-generating circuit shown in FIG. 15, even if any one of the sensors S9, S10, S11 and S12 gets out of order, the direction-object discrimination signal x can be generated by other normal sensors. Furthermore, the redundant control can be performed in such a fail-safe manner that any direction-object discrimination signal is not generated before the time point of generation of the direction-object discrimination signal in the normal state. Accordingly, when the direction-object discrimination signal x is generated, generation of an advance-admitting signal to the control section in the rear of the control section D in the direction of advance of an airplane becomes possible, and therefore, redundant fail-safe control of generation of advance-admitting signals becomes possible.

Then, the redundant control of generation of advance-inhibiting signals is described.

In the control circuit shown in FIG. 9, in the case where any one of the sensors in the control section D gets out of order, an advance-inhibiting signal is generated (the non-inhibition signal f2 disappears). However, in view of utilization of the taxiway 1, a certain control function is necessary in a control section provided with a plurality of sensors even if any one of these sensors gets out of order.

Figure 16:
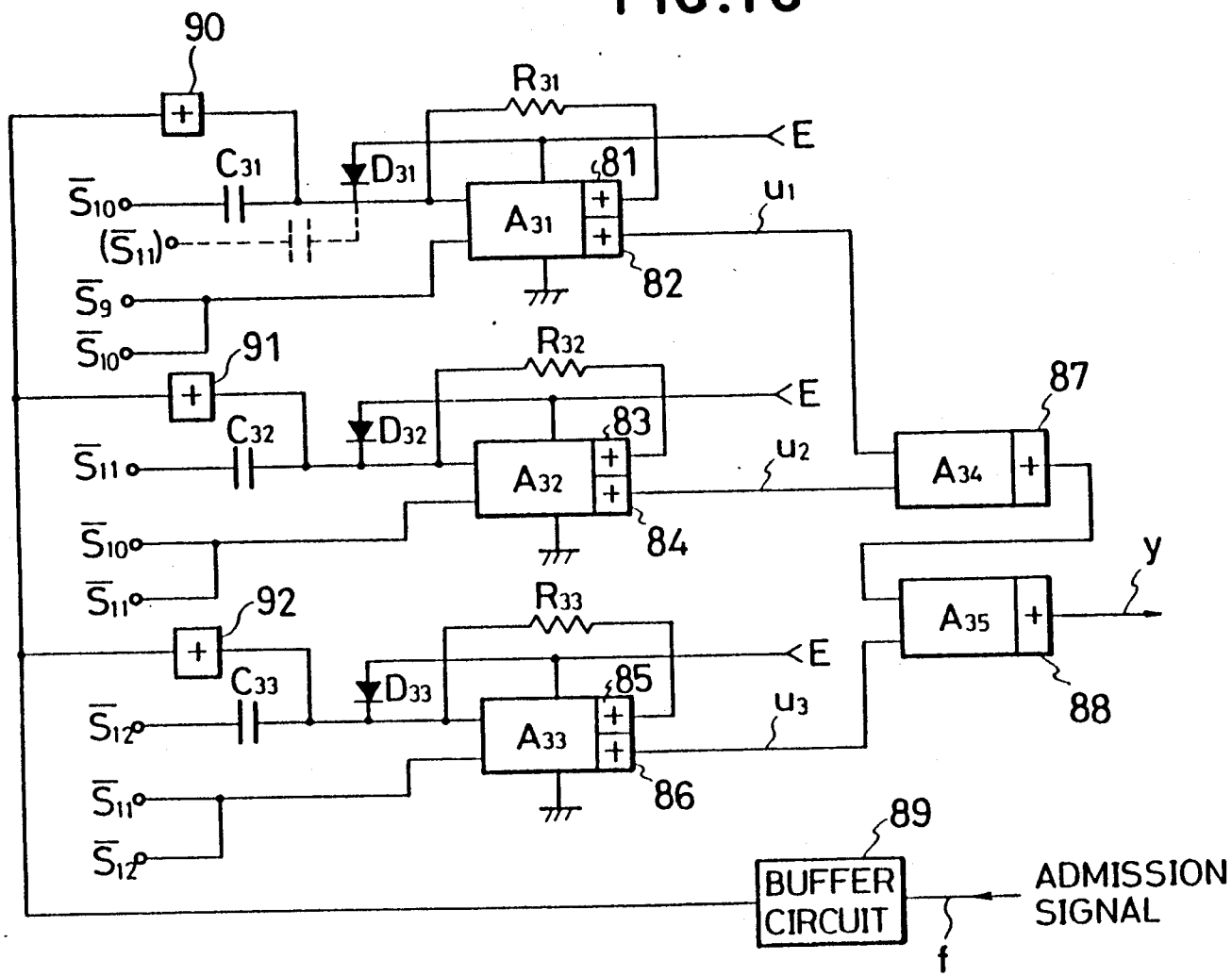
FIG. 16 is a diagram illustrating an inhibition signal-generating circuit having a redundant function.

FIG. 16 shows an advance-inhibiting signal-generating circuit for redundantly obtaining a signal for inhibiting advance in the control section D when one of a plurality of sensors gets out of order.

Referring to FIG. 16, AND gates A31, A32 and A33 receive output signals $\overline{S10}$, $\overline{S11}$ and $\overline{S12}$ of sensors S10, S11 and S12 as one input signal and wired OR outputs of $\overline{S9}$ and $\overline{S10}$, $\overline{S10}$ and $\overline{S11}$, and $\overline{S11}$ and $\overline{S12}$ as the other input signal. Capacitors C31, C32 and C33 and diodes D31, D32 and D33 are disposed to preset rising components of the output signals $\overline{S10}$, $\overline{S11}$ and $\overline{S12}$ of the AND gates A31, A32 and A33 (at the point of termination of detection of an airplane by each sensor), and they are clamped at the power source voltage E by the diodes D31, D32 and D33. The AND gates A31, A32 and A33 are provided with self-retention circuits in which outputs of the AND gates A31, A32 and A33 are fed back to one input sides through feedback resistors R31, R32 and R33 and are self-retained. An AND gate A34 is disposed to compute the logical product of the outputs of the AND gates A31 and A32, and an AND gate 35 is disposed to compute the logical product computation output of the AND gate A34 and the output of the AND gate A33. Rectifying circuits 81 through 88 are disposed to rectify oscillating outputs of the AND gates A31 through A35.

The advance-admitting signal f given from the control section ahead, in the direction of advance of an airplane, of the control section D is applied to input terminals on the preset sides of the AND gates A31, A32 and A33 through a buffer circuit 89 and rectifying circuits 90, 91 and 92 constituted by the AND gates circuits, and the AND gates A31, A32 and A33 are preset also by this advance-admitting signal f.

The operation will now be described with reference to the time chart of FIG. 17.

Figure 17:
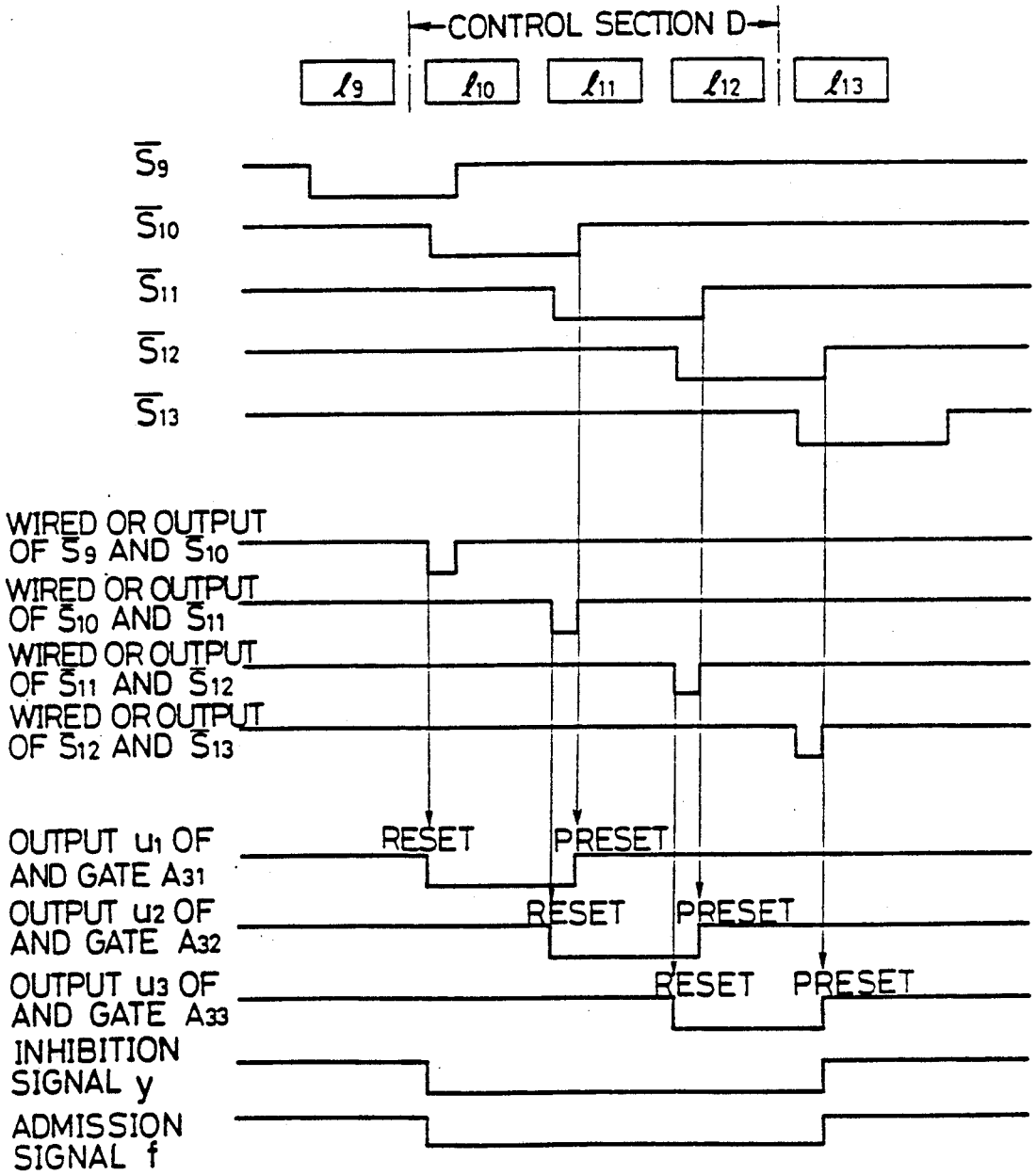
FIG. 17 is a time chart illustrating the operation of the inhibition signal-generating circuit shown in FIG. 16.

Of sensors S9 through S13, every two adjacent sensors put out detection signals ($\overline{Si}=0$) in the partially overlapped state with advance of an airplane, as shown in FIG. 17. When an airplane advances in the control section D and the sensor S10 detects this advance, since the sensor S9 still puts out a detection signal at this point the wired OR output of $\overline{S9}$ and $\overline{S10}$ is at an L level and the AND gate A31 is reset, with the result that the output Ul of the AND gate A31 disappears. Simultaneously, the outputs of the AND gates A34 and A35 disappear, and an advance-inhibiting signal y is put out.

Then, as the airplane runs, the output $\overline{S10}$ of the sensor S10 is changed to a non-detection signal from the detection signal, and by the rising component of this signal, the AND gate A31 is present, and the level of the output Ul of the AND gate A31 is increased to an H level and this signal is put in the AND gate A34. The same patterns are taken with respect to outputs U2 and U3 of the AND gates A32 and A33.

Since the reset states of the AND gates A31, A32 and A33 are partially overlapped on one another, the advance-inhibiting signal y is kept generated during the period of from the point of resetting of the AND gate A31 to the point of presetting of the AND gate A33, as shown in FIG. 17, that is, during the period from the point of detection of the airplane by loop coil λ 10 to the point of non-detection of the airplane by the loop coil λ 12.

In the advance-inhibiting signal-generating circuit which is operated in the above-mentioned manner, for example, if the loop coil λ10 or the sensor S10 gets out of order, since $\overline{S10}$ is 0 the output of the AND gate A31 disappears at the point of $\overline{S9}=0$, and the advance-inhibiting signal y is generated. The rising component of $\overline{S10}$ is not generated and the AND gate A31 is kept reset, but when the advance-admitting signal f is generated from the control section ahead of the control section D, the AND gate A31 is preset by this signal, and therefore, the advance inhibition range defined by the AND gate A31 is from the point of generation of the detection signal by the sensor S9 to the point of generation of the advance-admitting signal f. Incidentally, in this case, the operations of the AND gate A32 and A33 are the same as in the normal state. Accordingly, when the loop coil λ 10 or the sensor S10 gets out of order, the range of generation of the advance-inhibiting signal y in the control section D is the sum of the normal range and the range from the point of generation of the detection signal of the sensor S9.

When the loop coil λ 11 or the sensor S11 gets out of order, in the same manner as described above, the output U2 of the AND gate A32 is reset at the point of generation of the detection signal by the preceding sensor S10, and the advance-inhibiting signal is generated by the AND gate A32 until the output U2 is preset by the advance-admitting signal f. Also in this case, the AND gates A31 and A33 are normally operated, and therefore, the range of generation of the advance-inhibiting signal y is the same as the normal. In case of the loop coil 12 or the sensor S12 gets out of order, the range of generation of the advance-inhibiting signal is the same as the normal generation range.

Namely, the advance-inhibiting signal-generating circuit shown in FIG. 16 is constructed so that when one of the loop coils (i or the sensors Si gets out of order, the advance-inhibiting signal generation range is not made narrower than the normal advance-inhibiting signal generation range, and fail-safe redundant control can be performed without reduction of safety.

If the wired OR output of the output $\overline{S10}$ of the sensor S10 and the output $\overline{S11}$ of the subsequent sensor S11 is used instead of the output $\overline{S10}$ of the sensor S10 as the preset signal for the AND gate A31 as indicated by a dot line in FIG. 16, when the loop coil (10 or the sensor S10 gets out of order, the output U1 of the AND gate A31 rises at the point of generation of the non-detection signal by the sensor S11 and the advance-inhibiting range defined by the AND gate A31 can be extended to the point of termination of the detection by the sensor S11. Although the AND gate using the output of the sensor, which gets out of order, as the preset signal is kept in the reset state if an advance-inhibiting signal is once generated, by adopting a structure in which this AND gate can be preset even by the advance-admitting signal, it becomes possible to display admission of advance in the control section D for a subsequent airplane, and delay of guidance and control of airplanes is not caused.

As is apparent from the foregoing description, according to the present invention, since a plurality of loop coils are arranged in each control section of a taxiway and airplanes running on the taxiway are detected perpetually and continuously, the utilization efficiency of the taxiway can be increased. Furthermore, when a failure occurs in the system, outputs disappear without fail and a state similar to the state where an airplane is detected is produced to stop running of a subsequent airplane. Therefore, a fail-safe effect can be attained assuredly.

Industrial Applicability

As is apparent from the foregoing description, the ground guidance system for airplanes according to the present invention is effectively applied to an airport where airplanes frequently take off and land, and the utilization efficiency of the airport can be increased.

What is claimed is:

1. A ground guidance system for airplanes in an airplane taxiway divided in a plurality of control sections, which comprises a plurality of loop coils in which the side parallel to the direction of advance of airplanes has a length larger than the length of an automobile but smaller than the length of an airplane and which are arranged in the direction of advance of airplanes in the control sections at intervals smaller than the length of an airplane, a plurality of airplane-detecting means arranged for the respective loop coils to generate detection outputs indicating the presence or absence of an airplane based on changes of self-inductances of the corresponding loop coils, display means for displaying admission of advance or inhibition of advance in the control sections for an airplane, and control means of controlling said display means based on detection outputs of a plurality of said airplane-detecting means, wherein the airplane-detecting means is constructed so that a high-level output is generated at the time of non-detection of an airplane and a low-level output is generated at the time of detection of an airplane, and at the time of a failure, the output errs to a voltage corresponding to said low-level output at the time of detection of an airplane, said airplane-detecting means comprising a high-frequency signal generator, a bridge circuit including three resistors and a resonance circuit consisting of one said loop coil and a capacitor, which becomes substantially resonant with the output frequency of the high-frequency signal generator, an alternating current amplifier for amplifying the output of the bridge circuit, a wave-detecting circuit for detecting an envelope of the amplified output of the alternating current amplifier, a window comparator having such a window characteristic that the output signal of the wave-detecting circuit is received as the input signal, the output level of the wave-detecting circuit obtained when an airplane is not present in the taxiway is within the window and the output level of the wave-detecting circuit obtained when an airplane is present and the self-inductance of the loop coil is changed is outside the window, and generating an output when an input signal of the level within the window is put in, and a voltage multiplying rectifying circuit for rectifying the output of the window comparator.

2. A ground guidance system for airplanes according to claim 1, wherein the window comparator is constructed by connecting first and second input terminals of a logical product-computing oscillating means which generates an oscillating output when input signals of a predetermined high level higher than the level of a power source voltage are simultaneously applied to the first and second input terminals.

3. A ground guidance system for airplanes according to claim 2, wherein the logical product-computing oscillating means comprises a first transistor having a collector connected o the first input terminal of the logical product-computing oscillating means through a first collector resistor and an emitter connected to an input terminal of the power source, a second transistor having an emitter connected to the input terminal of the power source and a collector connected to a reference voltage source through second and third collector resistors connected in series, in which the collector voltage of the first transistor divided by a potential-dividing resistor formed by said second and third collector resistors arranged between the collector and the reference voltage source is put into a base of said second transistor, and a third transistor having a collector connected to the second input terminal of the logical product-computing oscillating means through fourth and fifth collector resistors and an emitter connected to said reference voltage source, in which the collector voltage of the second transistor divided by the second and third collector resistors is put into the base, and the input signal voltage applied to the second input terminal divided by the fourth and fifth collector resistors is put into the base of the first transistor through a resistor and the collector of the third transistor is connected to the output terminal of the logical product-computing oscillating means,.

4. A ground guidance system for airplanes in an airplane taxiway divided in a plurality of control sections, which comprises a plurality of loop coils in which the side parallel to the direction of advance of airplanes has a length larger than the length of an automobile but smaller than the length of an airplane and which are arranged in the direction of advance of airplanes in the control sections at intervals smaller than the length of an airplane, a plurality of airplane-detecting means arranged for the respective loop coils to generate detection outputs indicting the presence or absence of an airplane based on changes of self-inductances of the corresponding loop coils, display means for displaying admission of advance or inhibition of advance in the control sections for an airplane, and control means for controlling said display means based on detection outputs of a plurality of said airplane-detecting means, wherein the control means comprises a direction- and object-discriminating circuit for detecting the advance direction of an airplane and discriminating an airplane from an automobile based on an output from the airplane-detecting means corresponding to the loop coil within the control section in which an airplane advances and a display-instructing circuit for generating a signal for instructing admission of advance of an airplane or a signal for inhibition of advance of an airplane in the control section in the rear of the control section in which an airplane advances, based on the output of the airplane-detecting means corresponding to the loop coil of said rear control section and the output of the direction- and object-discriminating circuit.

5. A ground guidance system for airplanes according to claim 4, wherein the direction- and object-discriminating circuit generates a direction detection output of a high voltage only when an airplane moves from the inlet side to the exit side in the control section.

6. A ground guidance system for airplanes according to claim 5, wherein the direction- and object-discriminating circuit comprises a first AND gate connected to adjacent loop coils, in which the output of the airplane-detecting means is put through an inverter, first self-retention means for feeding back the rectified output of the first AND gate through a resistor to the input terminal of the first AND gate in which the output of the airplane-detecting means connected to the loop coil located on the inlet side of the control section is put and self-retaining the output of the first AND gate, a second AND gate in which the output of the first AND gate and the output of the airplane-detecting means connected to the loop coil on the inlet side of the control section are put, a third AND gate in which the rectified output of the second AND gate and the output of the airplane-detecting means connected to the loop coil located on the exit side of the control section are put, and a second self-retention means for feeding back the rectified output of the third AND gate through a resistor to the input terminal of the third AND gate in which the output of the second AND gate is put and self-retaining the output of the third AND gate.

7. A ground guidance system for airplanes according to claim 6, wherein the first, second and third AND gates constitute a logical product-computing oscillating means which generates oscillating outputs from the output terminals when input signals of a predetermined level higher than a power source voltage are applied to the first and second input terminals.

8. A ground guidance system for airplanes according to claim 6, wherein the display-instructing circuit comprises an advance-admitting signal generating means for generating an advance-admitting signal of a high voltage when a direction-setting signal fed from a manual operating device operated by an air traffic controller is in agreement with the output signal of the direction- and object-discriminating circuit and a running-admitting signal is supplied from the manual operating device, an advance-inhibiting signal-generating means for generating an advance-inhibiting signal of a low level for inhibiting advance of an airplane in the control section in the rear of the control section in which an airplane advances when an airplane-detecting signal is generated from at least one of the airplane-detecting means connected to the loop coils in said rear control sections and emitting an advance-inhibiting display-instructing signal of a low level to said display means, and an advance-admitting instructing means for emitting an advance-admitting display-instructing signal of a high level to said display means when the advance-admitting signal-generating means generates the advance-admitting signal and the advance-inhibiting signal-generating means does not generate the advance-inhibiting signal.

9. A ground guidance system for airplanes according to claim 8, wherein the advance-admitting signal-generating means comprises a fourth AND gate in which the output of the direction- and object-discriminating circuit and the direction-setting signal of the manual operating device are put and a fifth AND gate in which the rectified output of the fourth AND gate and the running-admitting signal of the manual operating device are put.

10. A ground guidance system for airplanes according to claim 9, wherein the fourth and fifth AND gates constitute a logical product-computing means generating oscillating outputs from the output terminals when input signals of a predetermined level higher than the level of a power source voltage are applied to the first and second input terminals.

11. A ground guidance system for airplanes according to claim 9, wherein the advance-inhibiting signal-generating means comprises a sixth AND gate receiving the outputs of the airplane-detecting means as inputs.

12. A ground guidance system for airplanes according to claim 11, wherein the sixth AND gate constitutes the logical product-computing oscillating means generating an oscillating output when input signals of a predetermined level higher than the level of power source voltage are applied to the first and second input terminals.

13. A ground guidance system for airplanes according to claim 12, wherein the advance-admitting instructing means comprises a seventh AND gate receiving the outputs of the advance-admitting signal-generating means and the advance-inhibiting signal-generating means as inputs.

14. A ground guidance system for airplanes according to claim 13, wherein the seventh AND gate constitutes a logical product-computing oscillating means generating an oscillating output from the output terminal when input signals of a predetermined level higher than the level of a power source voltage are applied to the first and second input terminals.

15. A ground guidance system for airplanes according to claim 8, wherein the manual operating device comprises a changeover switch for effecting changeover between automatic control and manual control of the display means, a direction-setting switch for generating the direction-setting signal for setting the advance direction of an airplane in the taxiway, a manual running-admitting instructing switch for optionally generating the running-admitting signal to the control section by an air traffic controller when the changeover switch is on the manual control side, and a running-inhibiting instructing changeover switch for cancelling the instruction signals of the changeover switch, the directionsetting switch and the manual running-admitting instructing switch and generating a running-inhibiting instructing signal.

16. A ground guidance system for airplanes according to claim 4, wherein the display-instructing circuit comprises an advance-admitting signal-generating means for generating an advance-admitting signal of a high level when a direction-setting signal supplied from a manual operating device operated by an air traffic controller is in agreement with the output signal from the direction- and object-discrimination circuit and a non-detection signal is generated from the airplane-detecting means connected to one said loop coil arranged in a predetermined area of the control section in the rear of the control section in which the running-admitting signal is put from the manual operating device, said ground guidance system further comprising an advance-inhibiting signal-generating means emitting an airplane advance-inhibiting signal of a low level to the control section in the rear of the control section when an airplane detection signal is generated from at least one of the airplane-detecting means connected to loop coils arranged in said predetermined area in the rear of said control section and emitting a signal of a low level for instructing display of inhibition of advance to said display means, and an advance-admitting instructing means for emitting a signal of a high level for instructing display of admission of advance only when the advance-admitting signal-generating means generates the advance-admitting signal and the advance-inhibiting signal-generating means generates the advance-inhibiting signal.

17. A ground guidance system for airplanes according to claim 8, wherein the display means comprises an advance-admitting signal lamp having a constant current source as a power source and displaying admission of advance to an airplane, an advance-admitting lamp controlling switch means for performing on-off control of the advance-admitting signal lamp based on instructions from an advance-admitting instructing means, an advance-inhibiting signal lamp having a constant current source as a power source and displaying inhibition of advance in a front control section to an airplane, and an advance-inhibiting lamp-controlling switch means for performing on-off control of the advance-inhibiting signal lamp based on instructions from the advance-inhibiting signal-generating means.

18. A ground guidance system for airplanes according to claim 17, wherein the advance-admitting lamp-controlling switch means comprises said constant current power source, said advance-admitting signal lamp connected to said constant current power source, a switch element connected in parallel to the advance-admitting signal lamp to control supply of an electric current to the advance-admitting signal lamp according to the input signal, a current-detecting means for detecting the electric current supplied to the advance-admitting signal lamp, which is controlled by said switch element, a watch means for determining normal and abnormal states of the advance-admitting lamp-controlling switch means based on the input signal and the detection output of the current-detecting means, and a current cut-off means for cutting the connection between the constant current power source and the advance-admitting signal lamp when said watch means detects the abnormal state.

19. A ground guidance system for airplanes according to claim 17, wherein the advance-inhibiting lamp-controlling switch means comprises said constant current power source, said advance-inhibiting signal lamp connected to said constant current power source and a switch element connected in parallel to said advance-inhibiting signal lamp, which is turned off when an input signal of a low level including an output at the time of a circuit failure is supplied and is turned on when an input signal of a high level not including an output at the time of a circuit failure is supplied.

20. A ground guidance system for airplanes according to claim 4, wherein the display-instructing means comprises a plurality of AND gates having, as a reset signal, a logical sum output of adjacent airplane-detecting means generating airplane-detecting outputs in sequence with the movement of an airplane and, as a present signal, the rising component of the output signal of the airplane-detecting means located, in the airplane advance direction, between one of said adjacent airplane-detecting means and an advance-admitting signal to a subsequent airplane in the airplane-advancing control section, which is generated in the control section in front of the airplane-advancing control section a plurality of self-retention circuits for feeding back the rectified outputs of the respective AND gates to preset input terminals of the AND gates and self-retaining the outputs of respective AND gates, and an advance-inhibiting signal-generating redundant control means having other AND gates which receive the outputs of said plurality of AND gates for generating an advance-inhibiting signal of a low level including a failure output when any one of the AND gates does not generate an output.

21. In a ground guidance system for airplanes having an airplane taxiway divided into a plurality of control sections, each control section having a plurality of loop coils for detecting vehicles on said taxiway, the improvement comprising:

said loop coils having a dimension parallel to the direction of advance of airplanes which is smaller than the length of an airplane to be detected and said loop coils being arranged in the direction of advance of airplanes on said taxiway in the control sections at intervals smaller than the length of an airplane, said length of said dimension of said loop coils in said direction of advance of airplanes being larger than the length of an automobile; each said loop coil being directly connected to airplane-detecting means to generate detection outputs indicating the presence or absence of an airplane in the vicinity of each said loop coil, wherein said airplane-detecting means comprises a high-frequency signal generator, a bridge circuit including three resistors and a resonance circuit consisting of one said loop coil and a capacitor, which becomes substantially resonant with the output frequency of the high-frequency signal generator, an alternating current amplifier for amplifying the output of the bridge circuit, a wave-detecting circuit for detecting an envelope of the amplified output of the alternating current amplifier, a window comparator means responsive to said wave-detecting circuit having a window characteristic such that the output level of the wave-detecting circuit obtained when an airplane is not present in the taxiway is within the window and the output level of the wave-detecting circuit obtained when an airplane is present and the self-inductance of the loop coil is changed is outside the window, for generating an output when an input signal of the level within the window is put in, and a voltage multiplying rectifying circuit for rectifying the output of the window comparator.

22. A ground guidance system for airplanes according to claim 4, wherein the display-instructing circuit comprises an advance-admitting signal generating means for generating an advance-admitting signal of a high voltage when a direction-setting signal fed from a manual operating device operated by an air traffic controller is in agreement with the output signal of the direction- and object-discriminating circuit and a running-admitting signal is supplied from the manual operating device, an advance-inhibiting signal-generating means for generating an advance-inhibiting signal of a low level for inhibiting advance of an airplane in the control section in the rear of the control section in which an airplane advances when an airplane-detecting signal is generated from at least one of the airplane-detecting means connected to the loop coils in said rear control sections and emitting an advance-inhibiting display-instructing signal of a low level to said display means, and an advance-admitting instructing means for emitting an advance-admitting display-instructing signal of a high level to said display means when the advance-admitting signal-generating means generates the advance-admitting signal and the advance-inhibiting signal-generating means does not generate the advance-inhibiting signal.

23. A ground guidance system for airplanes according to claim 22, wherein the advance-admitting signal-generating means comprises a first AND gate in which the output of the direction-and object-discriminating circuit and the direction-setting signal of the manual operating device are put and a second AND gate in which the rectified output of the first AND gate and the running-admitting signal of the manual operating device are put.

24. A ground guidance system for airplanes according to claim 23, wherein the first and second AND gates constitute a logical product-computing means generating oscillating outputs from the output terminals when input signals of a predetermined level higher than the level of a power source voltage are applied to the first and second input terminals.

25. A ground guidance system for airplanes according to claim 23, wherein the advance-inhibiting signal-generating means comprises a third AND gate receiving the outputs of the airplane-detecting means as inputs.

26. A ground guidance system for airplanes according to claim 25, wherein the third AND gate constitutes the logical product-computing oscillating means generating an oscillating output when input signals of a predetermined level higher than the level of a power source voltage are applied to the first and second input terminals.

27. A ground guidance system for airplanes according to claim 26, wherein the advance-admitting instructing means comprises a fourth AND gate receiving the outputs of the advance-admitting signal-generating means and the advance-inhibiting signal-generating means as inputs.

28. A ground guidance system for airplanes according to claim 27, wherein the fourth AND gate constitutes a logical product-computing oscillating means generating an oscillating output from the output terminal when input signals of a predetermined level higher than the level of a power source voltage are applied to the first and second input terminals.

29. A ground guidance system having an airplane taxiway divided into a plurality of control sections, each control section having a plurality of loop coils for detecting vehicles on said taxiway, wherein said loop coils have a dimension parallel to the direction of advance of airplanes which is smaller than the length of an airplane to be detected and said loop coils are arranged in the direction of advance of airplanes on said taxiway in the control sections at intervals smaller than the length of an airplane, said length of said dimension of said loop coils in said direction of advance of airplanes being larger than the length of an automobile; each said loop coil being directly connected to vehicle-detecting means to generate detection outputs indicating the presence or absence of an airplane in the vicinity of each said loop coil, wherein said vehicle-detecting means comprises a high-frequency signal generator, a bridge circuit including three resistors and a resonance circuit consisting of one said loop coil and a capacitor, which becomes substantially resonant with the output frequency of the high-frequency signal generator, an alternating current amplifier for amplifying the output of the bridge circuit, a wave-detecting circuit for detecting an envelope of the amplified output of the alternating current amplifier, a window comparator means responsive to said wave-detecting circuit having a window characteristic such that the output level of the wave-detecting circuit obtained when an airplane is not present in the taxiway is within the window and the output level of the wave-detecting circuit obtained when an airplane is present and the self-inductance of the loop coil is changed is outside the window, for generating an output when an input signal of the level within the window is put in, and a voltage multiplying rectifying circuit for rectifying the output of the window comparator.

30. A ground guidance system according to claim 29, further including control means including a direction- and object-discriminating circuit for detecting the advance direction of an airplane and means for discriminating an airplane from an automobile based on an output from the vehicle-detecting means corresponding to the loop coil within the control section in which an airplane advances and a display-instructing circuit for generating a signal for instructing admission of advance of an airplane or a signal for inhibition of advance of an airplane in the control section in the rear of the control section in which an airplane advances, based on the output of the vehicle-detecting means corresponding to the loop coil of said rear control section and the output of the direction- and object-discriminating circuit.

31. A ground guidance system for airplanes according to claim 30, wherein said display-instructing circuit comprises an advance-admitting signal generating means for generating an advance-admitting signal of a high voltage when a direction-setting signal fed from a manual operating device operated by an air traffic controller is in agreement with the output signal of the direction- and object-discriminating circuit and a running-admitting signal is supplied from the manual operating device, an advance-inhibiting signal-generating means for generating an advance-inhibiting signal of a low level for inhibiting advance of an airplane in the control section in the rear of the control section in which an airplane advances when a vehicle-detecting signal is generated from at least one of the vehicle-detecting means connected to the loop coils in said rear control sections and emitting an advance-inhibiting display-instructing signal of a low level to said display means, and an advance-admitting instructing means for emitting an advance-admitting display-instructing signal of a high level to said display means when the advance-admitting signal-generating means generates the advance-admitting signal and the advance-inhibiting signal-generating means does not generate the advance-inhibiting signal.

32. A ground guidance system according to claim 31, wherein the manual operating device comprises a changeover switch for effecting changeover between automatic control and manual control of the display means, a direction-setting switch for generating the direction-setting signal for setting the advance direction of an airplane in the taxiway, a manual running-admitting instructing switch for optionally generating the running-admitting signal to the control section by an air traffic controller when the changeover switch is on the manual control side, and a running-inhibiting instructing changeover switch for cancelling the instruction signals of the changeover switch, the direction-setting switch and the manual running-admitting instructing switch and generating a running-inhibiting instructing signal.

33. A ground guidance system according to claim 30, wherein the display-instructing circuit comprises an advance-admitting signal-generating means for generating an advance-admitting signal of a high level when a direction-setting signal supplied from a manual operating device operated by an air traffic controller is in agreement with the output signal from the direction- and object-discrimination circuit and a non-detection signal is generated from the airplane-detecting means connected to one said loop coil arranged in a predetermined area of the control section in the rear of the control section in which the running-admitting signal is put from the manual operating device, said ground guidance system further comprising an advance-inhibiting signal-generating means emitting an airplane advance-inhibiting signal of a low level to the control section in the rear of the control section when an airplane detection signal is generated from at least one of the vehicle-detecting means connected to the loop coils arranged in said predetermined area in the rear of said control section and emitting a signal of a low level for instructing display of inhibition of advance to said display means, and an advance-admitting instructing means for emitting a signal of a high level for instructing display of admission of advance only when the advance-admitting signal-generating means generates the advance-admitting signal and the advance-inhibiting signal-generating means generates the advance-inhibiting signal.

34. A ground guidance system according to claim 31, wherein the display means comprises an advance-admitting signal lamp having a constant current source as a power source and displaying admission of advance to an airplane, an advance-admitting lamp controlling switch means for performing on-off control of the advance-admitting signal lamp based on instructions from an advance-admitting instructing means, an advance-inhibiting signal lamp having a constant current source as a power source and displaying inhibition of advance in the front control section to an airplane, and an advance-inhibiting lamp-controlling switch means for performing on-off control of the advance-inhibiting signal lamp based on instructions from the advance-inhibiting signal-generating means.

35. A ground guidance system according to claim 29, wherein the control means comprises a plurality of direction- and object-discriminating circuits receiving an input signals the output signals of adjacent vehicle-detecting means in the control sections for generating airplane detection outputs in sequence with movement of an airplane and detecting the direction of advance of the airplane, a plurality of AND gates receiving the outputs of a plurality of the direction- and object-discriminating circuits as one input signal and receiving as another input signal wired OR outputs of vehicle-detecting means in to the rear of said control section, in the range from the last vehicle-detecting means to the vehicle-detecting means located just ahead of the vehicle-detecting means located on the opposite side to the airplane advance direction, the signal of which is put in the direction- and object-discriminating circuits, a wired OR circuit for computing the logical sum of the outputs of said AND gates, and a direction- and object-discriminating signal-generating redundant control means for converting the output of the wired OR circuit to a direction- and object-discriminating signal for forming an advance-admitting signal to the control sections to the rear of said control section.

36. A ground guidance system for airplanes according to claim 30, wherein the display-instructing means comprises a plurality of AND gates having, as a reset signal, a logical sum output of adjacent vehicle-detecting means generating vehicle-detecting outputs in sequence with the movement of an airplane and, as a present signal, the rising component of the output signal of the vehicle-detecting means located ,in the airplane advance direction, between one of said adjacent vehicle-detecting means and an advance-admitting signal to a subsequent airplane in the airplane-advancing control section, which is generated in the control section in front of the airplane-advancing control section, a plurality of self-retention circuits for feeding back the rectified outputs of the respective AND gates to preset input terminals of the AND gates and self-retaining the outputs of respective AND gates and an advance-inhibiting signal-generating redundant control means having other AND gates which receive the outputs of said plurality of AND gates for generating an advance-inhibiting signal of a low level including a failure output when any one of the AND gates does not generate an output.

* * * * *

UNITED STATES PATENT AND TRADEMARK OFFICE

CERTIFICATE OF CORRECTION

PATENT NO. : 5,027,114

DATED : June 25, 1991

INVENTOR(S) : Kawashima et al.

It is certified that error appears in the above-identified patent and that said Letters Patent is hereby corrected as shown below:

On the title page item [76] Inventors:

The inventor's name should be corrected to read

--Hiroshi Kawashima--

Signed and Sealed this

Sixteenth Day of February, 1993

*Attest:*

STEPHEN G. KUNIN

*Attesting Officer*

*Acting Commissioner of Patents and Trademarks*